US007913979B2

(12) United States Patent
Mann

(10) Patent No.: US 7,913,979 B2
(45) Date of Patent: Mar. 29, 2011

(54) SAILBOAT WINCH WITH SELF-STORAGE OF WORKING LINE

(76) Inventor: Samuel J. Mann, Englewood, NJ (US)

( * ) Notice: Subject to any disclaimer, the term of this patent is extended or adjusted under 35 U.S.C. 154(b) by 0 days.

(21) Appl. No.: 12/722,285

(22) Filed: Mar. 11, 2010

(65) Prior Publication Data

US 2010/0181542 A1 Jul. 22, 2010

Related U.S. Application Data

(62) Division of application No. 11/759,398, filed on Jun. 7, 2007, now Pat. No. 7,717,402.

(51) Int. Cl.
*B66D 1/14* (2006.01)

(52) U.S. Cl. ..... 254/339; 254/342; 254/346; 254/365

(58) Field of Classification Search ..... 254/266, 254/339, 342, 346, 348, 365, 370, 371, 383
See application file for complete search history.

(56) References Cited

U.S. PATENT DOCUMENTS

| | | | |
|---|---|---|---|
| 2,660,382 | A | 11/1953 | Wilson |
| 3,309,066 | A | 3/1967 | Carlson |
| 3,815,846 | A | 6/1974 | Biewer |
| 4,334,670 | A | 6/1982 | Kawabe |
| 4,513,772 | A | 4/1985 | Fisher |
| 4,795,108 | A | 1/1989 | Appling |
| 4,921,219 | A | 5/1990 | Ottemann et al. |
| 5,284,323 | A | 2/1994 | Pawkett |
| 5,775,614 | A | 7/1998 | Yamaguchi |
| 5,967,496 | A | 10/1999 | Ulrich et al. |
| 6,315,228 | B1 | 11/2001 | Sato |
| 6,431,103 | B1 | 8/2002 | Meyerdierks |
| 6,595,495 | B1 | 7/2003 | Hung |
| 7,108,217 | B2 | 9/2006 | Hamm et al. |
| 7,380,742 | B2 | 6/2008 | Stevens |
| 2002/0104915 | A1 | 8/2002 | Hanlon |
| 2004/0262443 | A1 | 12/2004 | Hamm et al. |
| 2005/0087644 | A1 | 4/2005 | Kim |
| 2005/0116079 | A1 | 6/2005 | Stevens |
| 2006/0011765 | A1 | 1/2006 | Dion |
| 2006/0237565 | A1 | 10/2006 | Barker et al. |
| 2007/0241224 | A1 | 10/2007 | Nagler |

OTHER PUBLICATIONS

International Search Report and Written Opinion of the International Searching Authority; PCT/US08/65864; Sep. 23, 2008; 8 pages.

*Primary Examiner* — Emmanuel M Marcelo
(74) *Attorney, Agent, or Firm* — St. Onge Steward Johnston & Reens LLC

(57) ABSTRACT

A power or manually operated winch mechanism for handling the running rigging lines of a sailing yacht. The winch includes a winding drum, operating in conjunction with a level wind mechanism. A special, manually operated line release clutch allows controlled release of line independently of the power or manual drive mechanisms of the winch, providing for quick release under emergency conditions as well as for a convenient, manually controlled release for sail control purposes. During line release by power or manual rotation of the winding drum, the line is tensioned by the level wind mechanism and thus positively drawn from the unwinding winch drum The arrangement enables lines to be automatically released from one winch and retrieved on a second winch, under a common control, as when tacking or resetting sails, without any physical line handling by crew members, with resulting improvement in the safety and convenience of the crew.

8 Claims, 15 Drawing Sheets

SAILBOAT WINCH WITH SELF-STORAGE OF WORKING LINE

CROSS-REFERENCE TO RELATED APPLICATIONS

The present application is a division of U.S. patent application Ser. No. 11/759,398 filed on Jun. 7, 2007 now U.S. Pat. No. 7,717,402 which application is currently pending and which application is hereby incorporated by reference herein in its entirety.

FIELD OF THE INVENTION

This invention relates to sail handling winches for sailing yachts and particularly to power driven winches having novel and advantageous control features enabling manual override of certain operations when desired and facilitating manual operation in the event of malfunction of the power drive means.

BACKGROUND OF THE INVENTION

Sailing yachts of greater than minimal size typically utilize one or more winches to assist in handling of the running rigging. The running rigging normally consists of lines, which are used for hoisting the sails (halyards), and also for trimming the sails (sheets). On larger yachts, the forces required for operating the sheets and halyards can become too great for ordinary manual handling, requiring the use of winches to achieve mechanical advantage. A typical simple winch includes a rotatable capstan or drum about which a line is wound. The "tail" of the line, on the downstream side of the winch drum, is maintained under tension, either manually or by a self-tailing mechanism, so that friction of the line on the surface of the winch drum enables the line to be drawn in with considerable force. In the larger yachts, it is common to utilize multiple speed winches and/or power driven winches for handling of the sheets and halyards under heavy loads.

With a winch of typical design, the line is wrapped multiple times around the exterior of the winch drum and, as the line is drawn in by manual or powered rotation of the drum, the tail of the line, exiting from the downstream side of the winch, tends to collect haphazardly on the deck or cockpit floor. Once hoisting or trimming operations are completed, the line typically is secured on the downstream side of the winch, by means of a cleat and/or self-tailing jaws of the winch. The leftover tail can then be gathered and collected into a neater coil.

Particularly for sheets, used in trimming the jib, main sail and other sails of a yacht, adjustment of the sail trim, either by letting a sheet out or winching it in, is performed with considerable frequency, to compensate for variations in the force and direction of the winds, changes in the course of the yacht, etc. Thus, handling, coiling and re-coiling of lines is a continuing activity, which can be somewhat tedious and, especially with larger yachts, can involve a considerable element of risk because of the very large forces acting on the lines. For example, the actions involved in simply easing a jib sheet include initially releasing the line from a cleat and/or self-tailing jaws of the winch, perhaps taking one or two wraps of line off of the winch drum, and then manually allowing the line to slip on the winch drum until a desired amount of line has been released. Thereafter, any wraps removed from the winch are rewound and the line re-secured in the self-tailing jaws and/or cleat. Because jib sheets can be under very significant tension loads, if these operations are not carefully performed there is an ever present possibility of serious injury to crew members. If too many wraps are removed, or a crew member becomes careless, a line can escape and run rapidly through the crew member's hands. Serious burns can result. This is true each time a line is handled, whether in easing or trimming jib sheets. Also, when using conventional winches, the "tails" of the lines, initially at least, collect loosely in the cockpit, enabling lines to be easily confused and/or tangled.

SUMMARY OF THE INVENTION

In accordance with the present invention, a novel and significantly improved yacht winch is provided, which not only retrieves and releases the working lines of a sailing yacht without physical handling of the lines by crew members but also winds up and stores the retrieved line in neat coils on the winch drum. This completely eliminates the otherwise frequent coiling and re-coiling of lines required in order to maintain a shipshape and safe yacht. The new winch takes full advantage of modern high strength, low stretch lines, which can be of substantially smaller diameter than older, conventional lines, while providing the strength necessary for the required sail handling tasks.

In one preferred form, the winch of the invention is primarily power operated, typically by an electric or hydraulic power source, uniquely combined with a manually operated mechanism, which can be used as a back-up in case of failure of the on-board power systems. It is contemplated, however, that the winch may be provided in modified forms, intended for operation exclusively by power means or exclusively by manual means.

Importantly, the winch arrangement of the invention, whether intended to be used in a power mode or manually, provides for controllably releasing as well as trimming lines in by controlled rotation of a winding drum on which line is stored. In the power mode, the winding drum can be driven in either direction to wind in or release line from the drum. In a manual mode, a clutch is used for controllably releasing line from the drum. This is in significant contrast to conventional winching systems, in which power is utilized only to trim lines, under load, while the lines typically are eased or released manually, by being allowed to slip, in the manner described above.

Pursuant to the invention the new winch utilizes a winding drum, which can be operated in either direction, for retrieving, releasing and storing line. The winch of the invention incorporates an advantageous form of level wind mechanism, which engages and guides the line, as it approaches the winding drum during winding operations, assuring that the incoming line is applied neatly to the drum, in tight, uniform layers back and forth along the entire axial length of the drum. In a particularly preferred embodiment of the invention, the line guide mechanism includes a novel and advantageous arrangement for imparting nominal tension to line being retrieved onto the winding drum, and for imparting more significant tension to line being released from the winding drum during power driven operation of the winding drum in a line releasing or line unwinding direction. In this respect, under certain circumstances, such as when tacking a sailing yacht, a considerable length of line must be drawn in and wound onto the winding drum while the line is substantially slack and under little or no tension. Under these circumstances, it is advantageous to apply artificial tension to the line as it is being wound onto the winding drum, to assure formation of tight, neatly wound coils. Among other things, this enables more line to be stored on the winding drum.

During later stages of the line retrieval, the lines will be placed under tension by wind loading on the sail, but it is important that underlying coils, retrieved when there is no natural tension load on the line, be wound in a neat and compact manner, without overrides or crossovers, and this is achieved by means of the new level wind mechanism during initial stages of retrieval.

It has previously been suggested to provide a level wind feature in a winching arrangement, including a drum for the wind-up and storage of running rigging lines (U.S. Pat. No. 4,921,219), but this prior suggestion involves the provision of two separate drums: a power-driven capstan drum, which applies the torque necessary to trim in a line under the customary heavy operating loads, and a separate winding drum which functions with a level wind feature to take up and store the tail of the line, on the downstream side of the primary capstan drum. Because of the weight, cost and complication of this arrangement, it is of limited practical usefulness. It is suitable only for the very largest of sailing yachts and is intended to be installed entirely below deck, where its operation cannot be easily monitored. The winch arrangement of the invention, including its level wind mechanism, is of a very compact and strong design and is advantageously positioned on the deck of the yacht, where its operations can easily be observed and controlled.

Importantly, the level wind mechanism of the invention includes means for gripping and applying tension to the line while it is being unwound under power from the winch, in order to strip line off of the drum and prevent the line from reverse winding on the drum, as can occur when line is being released under no tension load from the sail. In this respect, during the tacking of a yacht, when the yacht is approaching and passing a head-to-wind orientation, there is essentially no tension on the line being released. This may also be true at times when sailing at a large angle off the wind. Under such conditions, as the winding drum is driven to rotate in a line-releasing direction, line is stripped off of and cleared from the winding drum by the level wind mechanism to prevent fouling of the line within the winch mechanism.

The winch mechanism of the invention not only enables powered operation of the winch for both retrieving and releasing operations, but a pair of winches may be set up for unified control, whereby when the winch on one side is operated in a retrieving direction, the opposite side winch is automatically operated in a releasing direction. In this manner, a tack can be executed by manipulation of a single winch control, without manual intervention of any crew member at either of the winches involved in the tacking operations. Among other things, this makes it more convenient and safe to operate a yacht short handed, or even single handed.

It is contemplated that the winch mechanism of the invention will be utilized principally on medium-sized yachts, for example in a size range of around 35-55 feet in length. It is further contemplated that, for yachts of the primary size range, the winch operation will be primarily, if not exclusively, by power means. However, recognizing that on-board power systems may fail from time to time, the winch arrangement of the invention includes a novel and advantageous mechanical operating system, which may be utilized as a backup in the event of power failure or otherwise when desired by the yacht captain. It is to be understood, of course, that many of the operating principles of the new winch are such that the winch, with appropriate modifications, may be utilized to advantage on yachts of larger or smaller sizes than indicated above. Moreover, the rugged and compact design of the winch enables a winch of given size to be utilized an a wide range of yacht sizes, in contrast to conventional yacht winches which, for a given winch size, are optimum over a relatively small range of yacht sizes.

In a preferred embodiment of the invention, a novel mechanical drive arrangement is provided which can be selectively actuated to provide for a multiple speed manual backup operation when needed or desired. The new winch offers convenient means for simultaneously enabling the manual drive mechanism while disabling the motor powered drive, (or vice versa). This is preferably and conveniently accomplished by means of standard winch handle engaged with a primary drive sleeve in such a way that rotation of the winch handle in a winding-in direction will engage the manual drive mechanism and disengage the power drive, and rotation of the handle in the opposite direction will disable the manual mechanism and engage the motor powered means for powered operation of the winch.

To advantage, the winch of the invention, in a preferred embodiment, provides an advantageous arrangement for achieving three-speed manual operation, when desired. To this end, the primary drive sleeve, referred to above, is connected directly to the winding drum for one-to-one rotation by a winch handle, for maximum retrieval speed with minimum mechanical advantage. By moving the winch handle to a second socket, two additional winding speeds are provided, depending on the direction of rotation of the winch handle, to achieve the higher mechanical advantages necessary to winch in lines manually under heavy loads.

With a standard winch, release of running rigging lines is accomplished by removing one or more turns of line on the winch drum and easing the tailing pressure on the line to allow it to slip controllably over the surface of the drum. After an adjustment, the line is re-wrapped on the winch and again cleated or otherwise secured on the downstream side of the winch. With the winch of the invention, easing of the lines involves controlled unwinding rotation of the winding drum. Under the power operating modes (i.e., power only or power with manual backup), this involves driving the winch drum under power in an unwinding direction, by operating the motor in a reverse direction. In the manual mode, however, (whether manual only mode or using manual backup on a powered winch) a clutch arrangement is provided to enable controlled rotation of the drum in the line releasing direction under the tension force of the line being released. To this end, the winch of the invention incorporates an advantageous form of adjustable line release clutch, which can be manually manipulated between limit positions. In one limit position, a substantially positive drive connection is provided. In the opposite limit position, substantially free rotation of the winding drum is enabled. By manipulation of a convenient control handle, the clutch can also be set at multiple intermediate positions, in which the line can be released at various levels of resistance. This enables closely controlled easing of a jib sheet in a manually operated mode. It also enables controlled resistance to be applied to jib sheets when rolling up a furling jib, for example, Furling jibs are virtually standard on yachts of the size contemplated, and proper furling of the sail in a tight, orderly roll is important, both aesthetically and to minimize windage.

In accordance with another advantageous feature of the invention, a complex power operated winch mechanism, with alternate multi-speed manual backup, can be provided in an unusually low profile configuration, with essentially only the winding drum and level wind mechanisms above deck, and with the gear box and power drive arrangements located below deck. A novel arrangement is provided for securing the gear box and power drive below decks, where desired, in a manner to be properly spaced from yet functionally operative with the above deck hardware, notwithstanding the thickness of the deck and variations in such thickness arising, for example from production tolerances. Thus, the winding drum and level wind mechanism located above deck, can be operatively coupled with the gear box and power drive, on the underside of the deck, without requiring special adapters or the like to take into account variations in the thickness of the deck and/or variations in the thickness over the span of the footprint of the winch.

For a more complete understanding of the above and other features and advantages of the invention, reference should be made to the following detailed description of a preferred embodiment, and to the accompanying drawings.

DETAILED DESCRIPTION OF THE INVENTION

Figure 1:
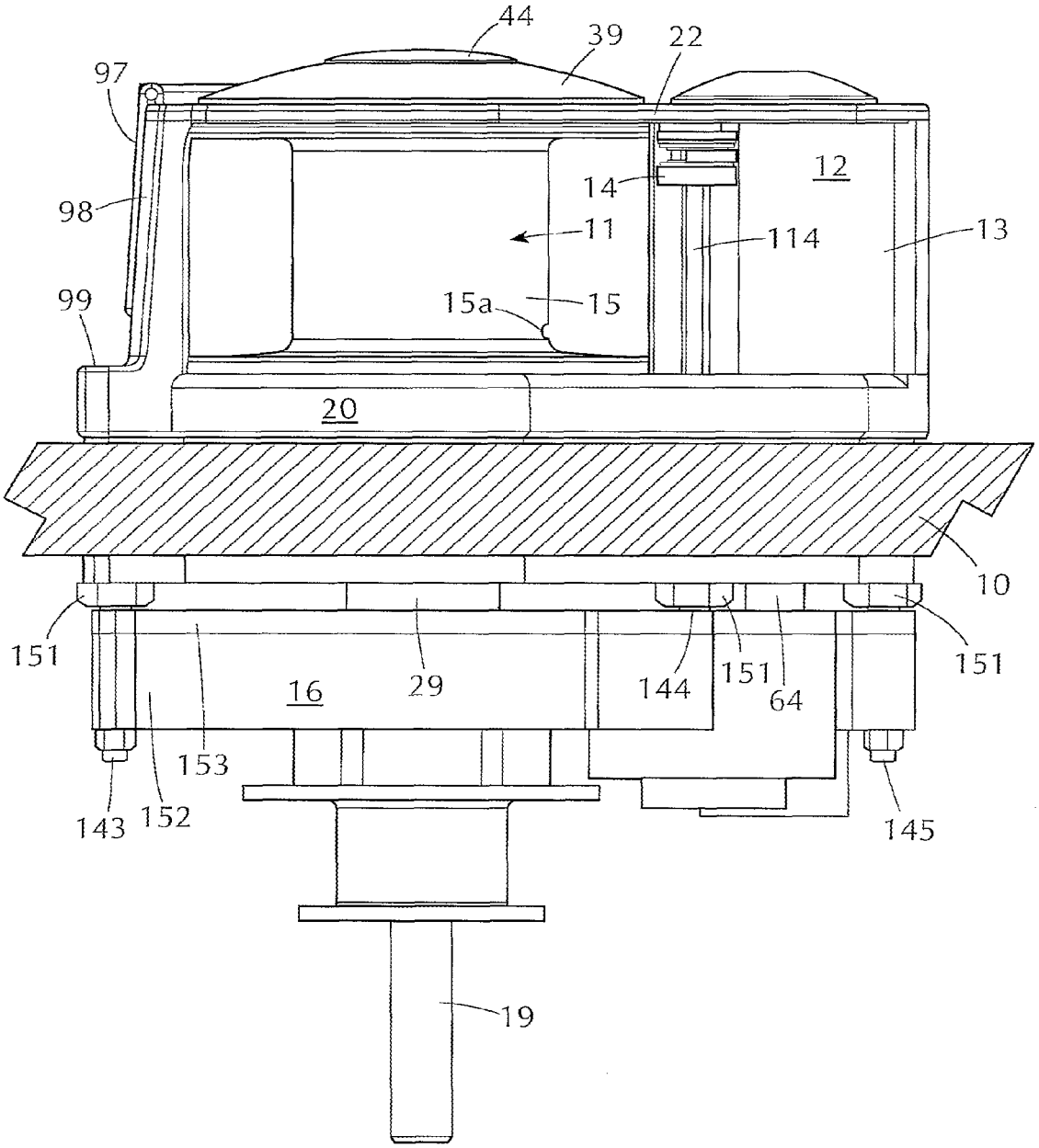
FIG. 1 is a side elevational view showing features of the new winch, as mounted on the deck of a sailing yacht.
Figure 2:
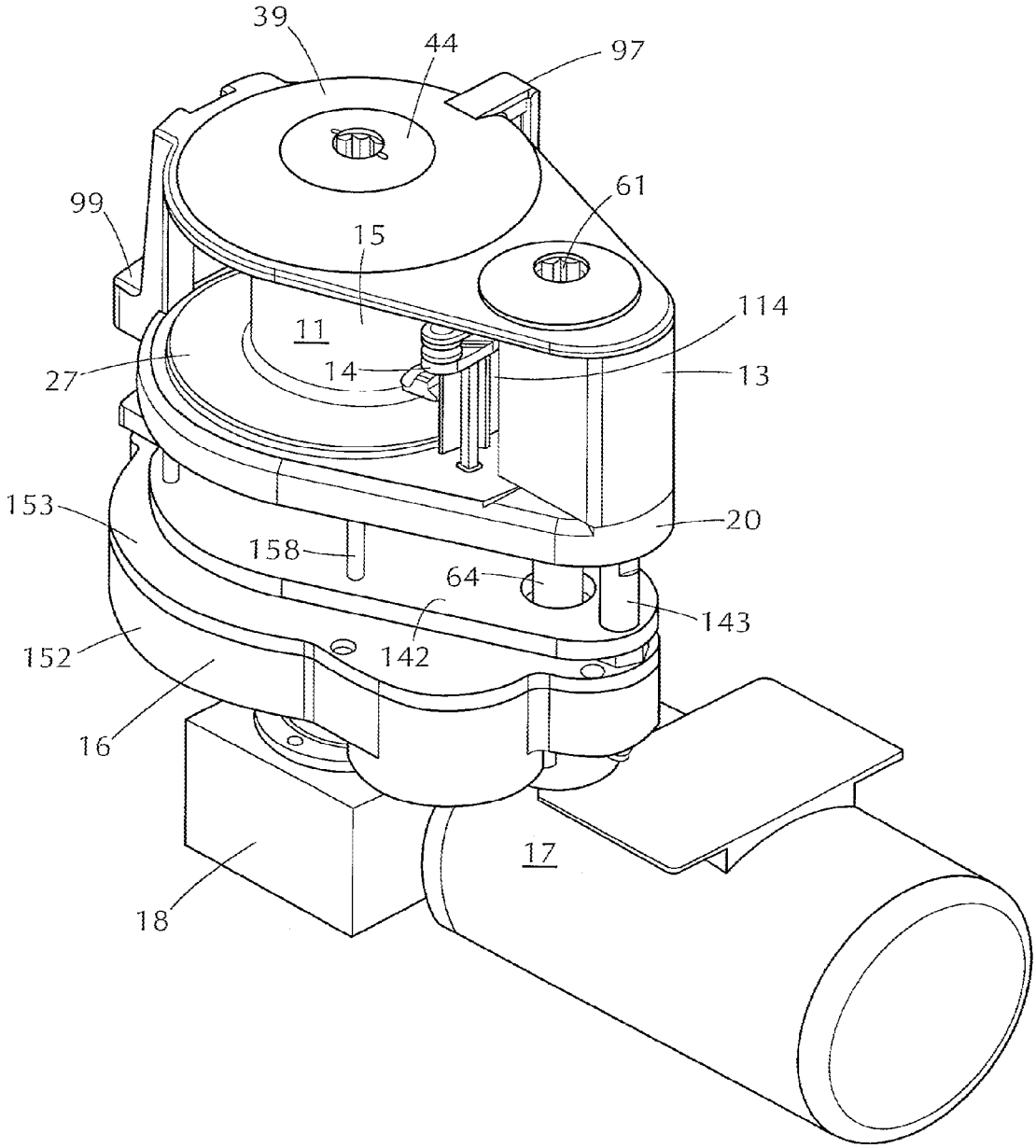
FIG. 2 is a perspective view from above of the new winch.
Figure 3:
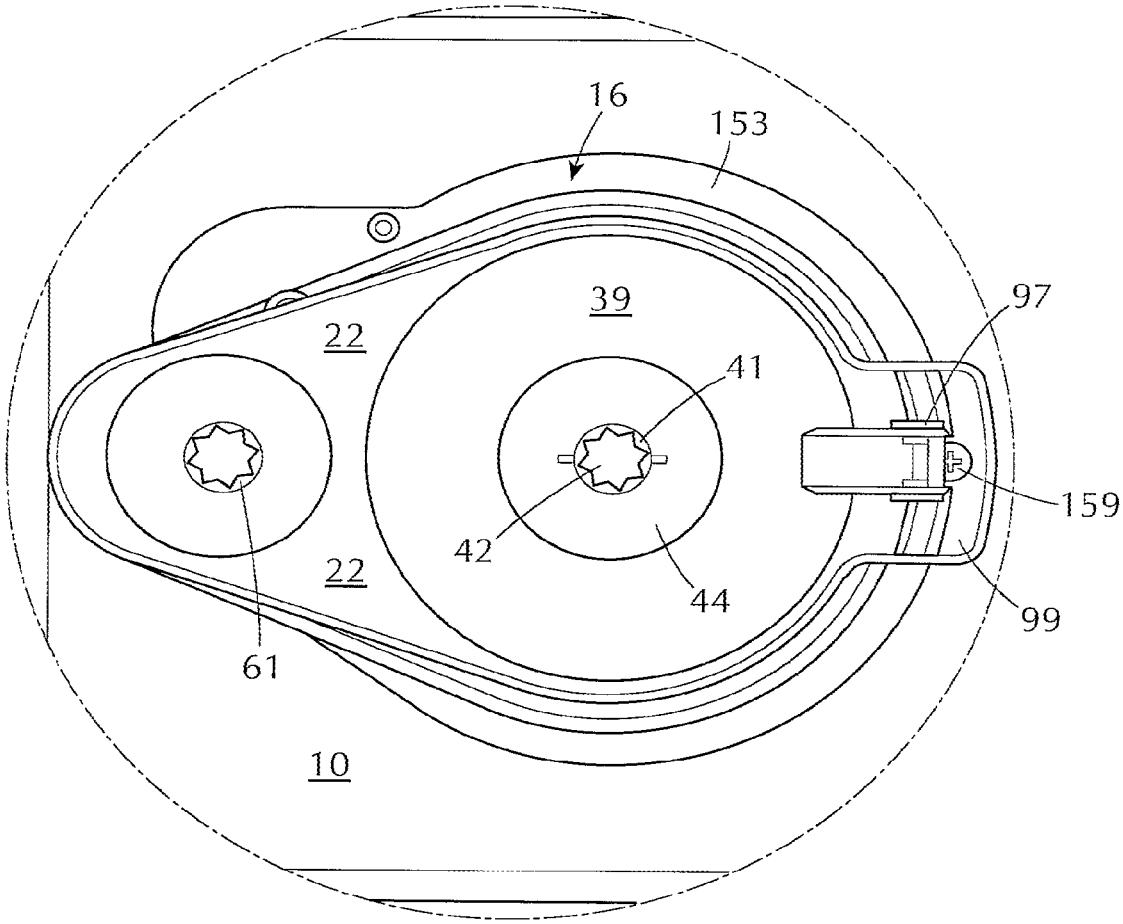
FIG. 3 is a top plan view of the winch.
Figure 4:
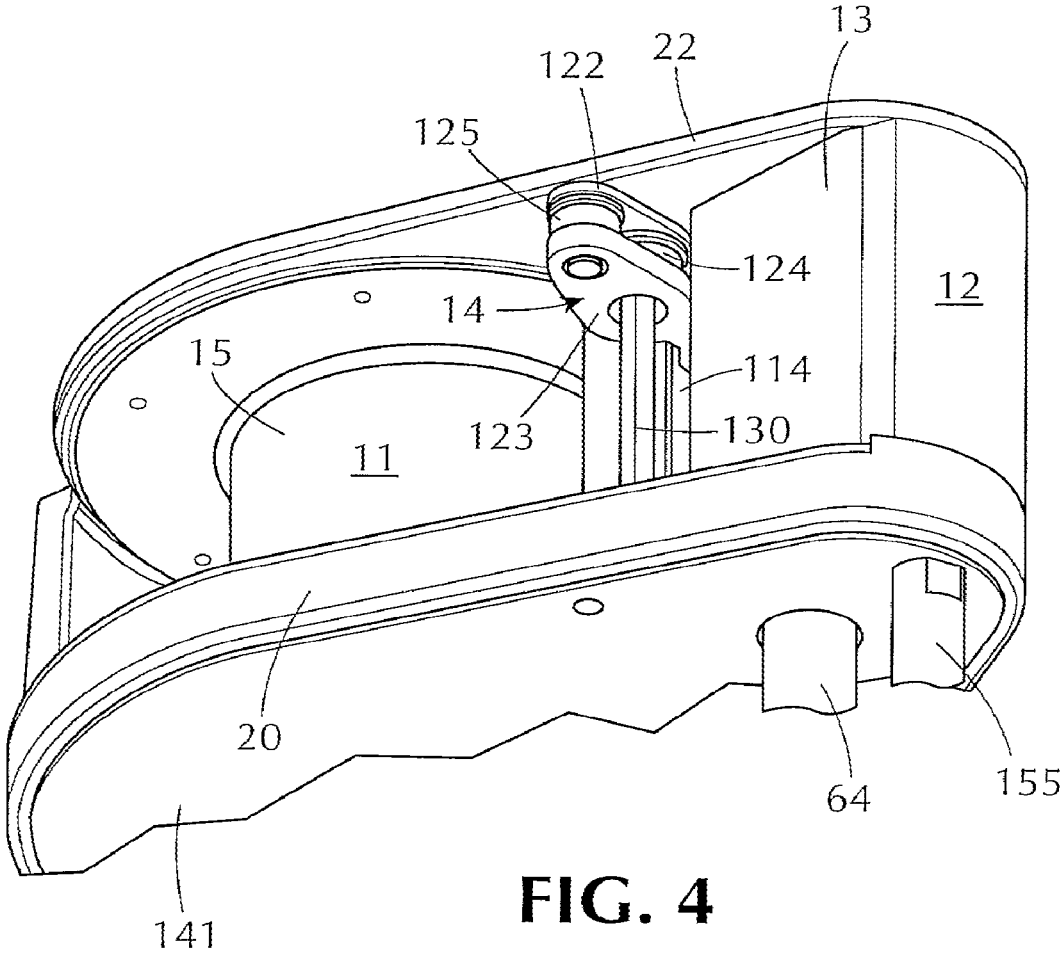
FIG. 4 is a partial perspective view from below showing features of the level wind mechanism.

Referring now to the drawings, and initially to FIGS. 1-4 thereof, the reference numeral 10 indicates a deck structure of a sailing yacht on which is mounted the winch of the invention. The winch includes a flanged winding drum 11 supported for rotation on a winch base 20. Positioned forwardly of the flanged drum 11 is a level wind mechanism, generally designated by the numeral 12 which, in the illustrations of FIGS. 1 and 2, is largely concealed within a protective housing 13. A rigging line passes through a movable line guide 14 and is attached to the core 15 of the winding drum, by a suitable keyhole engagement or the like 15*a*. Alternatively, the drum may be formed with a post or hook, to engage a suitable eye fitting at the end of the line to enable the line to be easily engaged to or disengaged from the winding drum. As will be further described herein, as line is wound upon the winch drum by rotation thereof, the line guide 14 travels vertically up and down a predetermined oscillating path extending over the full height of the drum, at a rate such as to cause the incoming line to be applied to the winding drum 11 in tight, side-by-side coils, in successive layers.

A gear box 16, containing mechanisms for manually driving the winding drum 11, can be mounted below the deck 10, in a manner to be more fully described. A drive motor, indicated at 17 in FIG. 2, is connected through a right angle worm gear mechanism 18 to an output shaft 19 (FIG. 1). When the output shaft is connected to the winding drum 11, winding drum is rotated directly by means of the motor 17, which typically is electrically or hydraulically powered.

Figure 5:
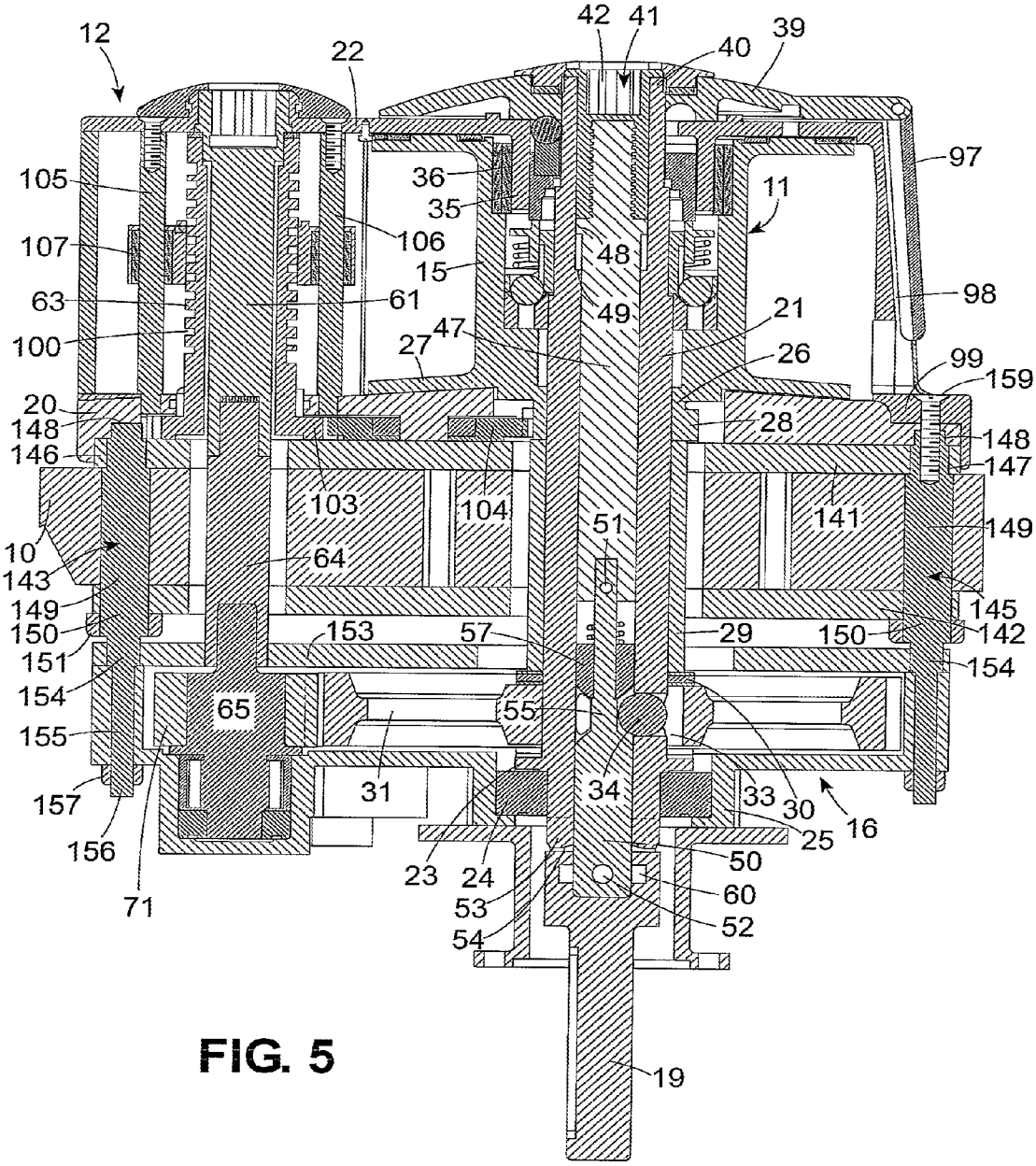
FIGS. 5 and 6 are cross sectional views taken centrally through the winch, illustrating different settings of two clutch mechanisms incorporated therein.
Figure 6:
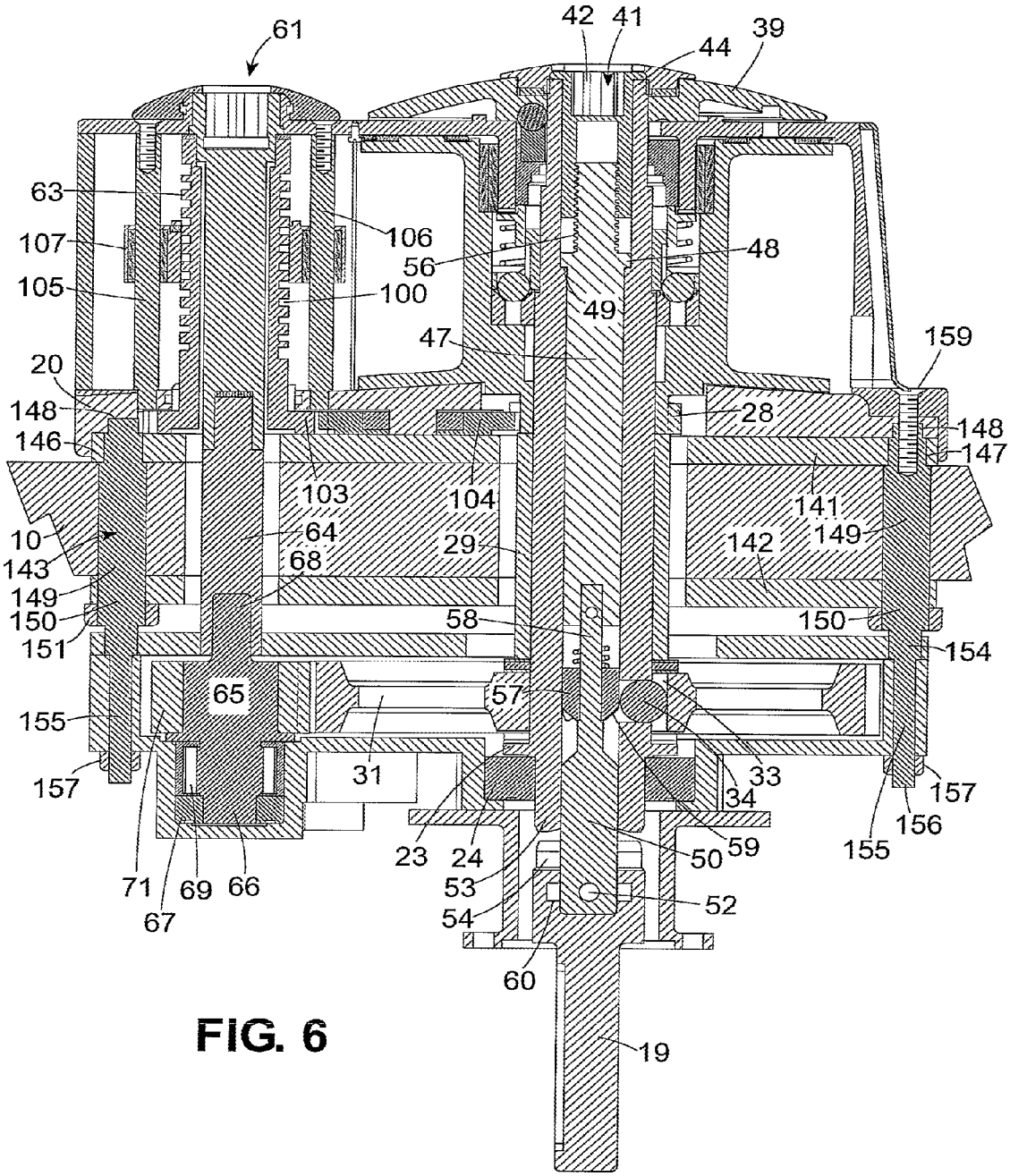

Referring now to FIGS. 5 and 6, FIG. 5 illustrates the winch in its primary operating configuration, set to be driven by the motor 17 through the vertical output shaft 19. The winding drum 11 is supported for rotation on the base 12. A primary drive sleeve 21 extends upwardly through the gear box 16 and through the core 15 of the winding drum, projecting somewhat above a cover structure 22 extending over the top of the winch assembly. The drive sleeve 21 is formed with a flange 23 near its lower end, which rests upon a bearing 24 seated in a recess 25 in the gear box.

A lower portion 26 of the winding drum 11 projects downward, below the lower flange 27 of the drum, in close-fitting relation to the drive sleeve 21. This lower portion 26 is formed as a gear 28 which couples the winding drum to a level wind mechanism, to be described hereinafter. A spacer bearing 29 extends downward from the gear 28 and rests upon a bearing washer 30, seated on a main, large diameter main drive gear 31 (see FIG. 9). The main drive gear 31 is located in the gear box 16 and is mounted for rotation about the primary drive sleeve 21. The hub 32 of the main drive gear 31 is formed with a plurality of recesses 33, each arranged to receive a portion of a driving ball 34. In the configuration of FIG. 5, the driving balls 34 are recessed within the primary drive sleeve 21, out of driving relation to the main drive gear 31, enabling motor powered rotation of the drive sleeve 21 independently of the drive gear 31.

As shown in FIGS. 5-8, the cover structure 22 of the winch is formed with a downwardly projecting cylindrical portion 35. The outer surface of the cylindrical projection supports a bearing 36, which is received in an internal recess 37 in the core 15 of the winding drum, supporting upper portions of the winding drum for rotation about the axis of the primary drive sleeve 21.

In the illustrated form of the invention, the winding drum 11 is connected to the primary drive sleeve 21 by means of a line release clutch mechanism housed between the drum core 15 and upper portions of the drive sleeve 21. The line release clutch mechanism, designated generally by the reference numeral 38, will be described in detail hereinafter. In the configuration of FIG. 5 the primary drive sleeve 21 and the winding drum 11 are effectively locked for rotation in unison.

A clutch actuating cap 39 is mounted on top of the winch cover 22. The cap has an opening in the center to receive a projecting upper portion 40 of the primary drive sleeve 21. A first socket member 41, having an octagonal socket 42 of standard configuration for engagement with a standard winch handle (not shown), is received in the upper portion 40 of the drive sleeve 21. The socket member is formed with a flange 43 at its upper end, which seats against the top of the sleeve projection 40, as shown in FIGS. 5-8. A retainer cap 44 threadedly engages the uppermost extremity of the sleeve projection 40 at 45 (see FIG. 7, 8) and serves to secure the socket member 41 in its position at the top of the sleeve 21. In addition, portions of the retaining cap overlie the actuator cap 39, via a ring washer 46, such that the retaining cap 44, while being rotatable with respect to the actuator cap 39, serves to retain it in position on top of the winch cover structure 22.

Figure 7:
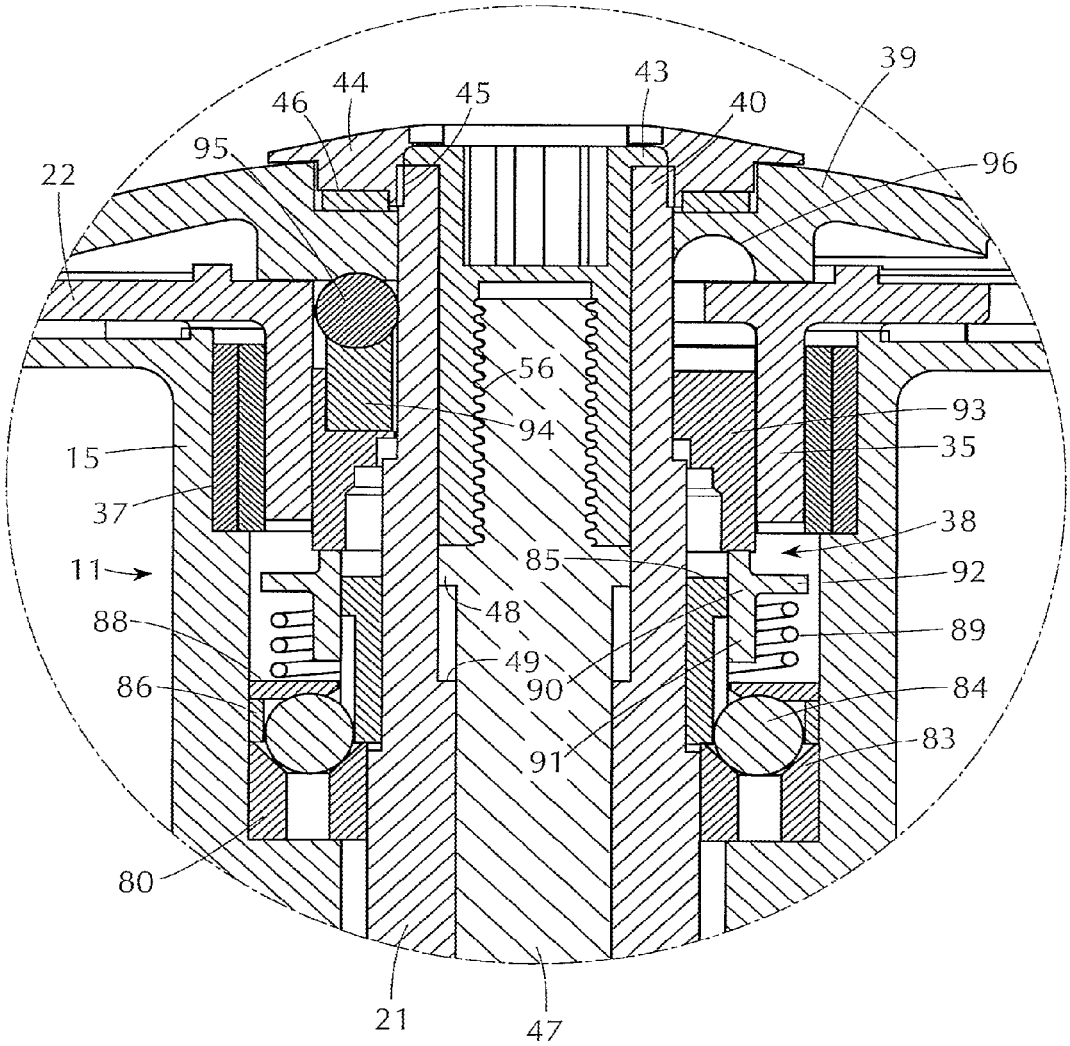
FIGS. 7 and 8 are enlarged, fragmentary cross sectional views showing the two clutch mechanisms in different operating positions.
Figure 8:
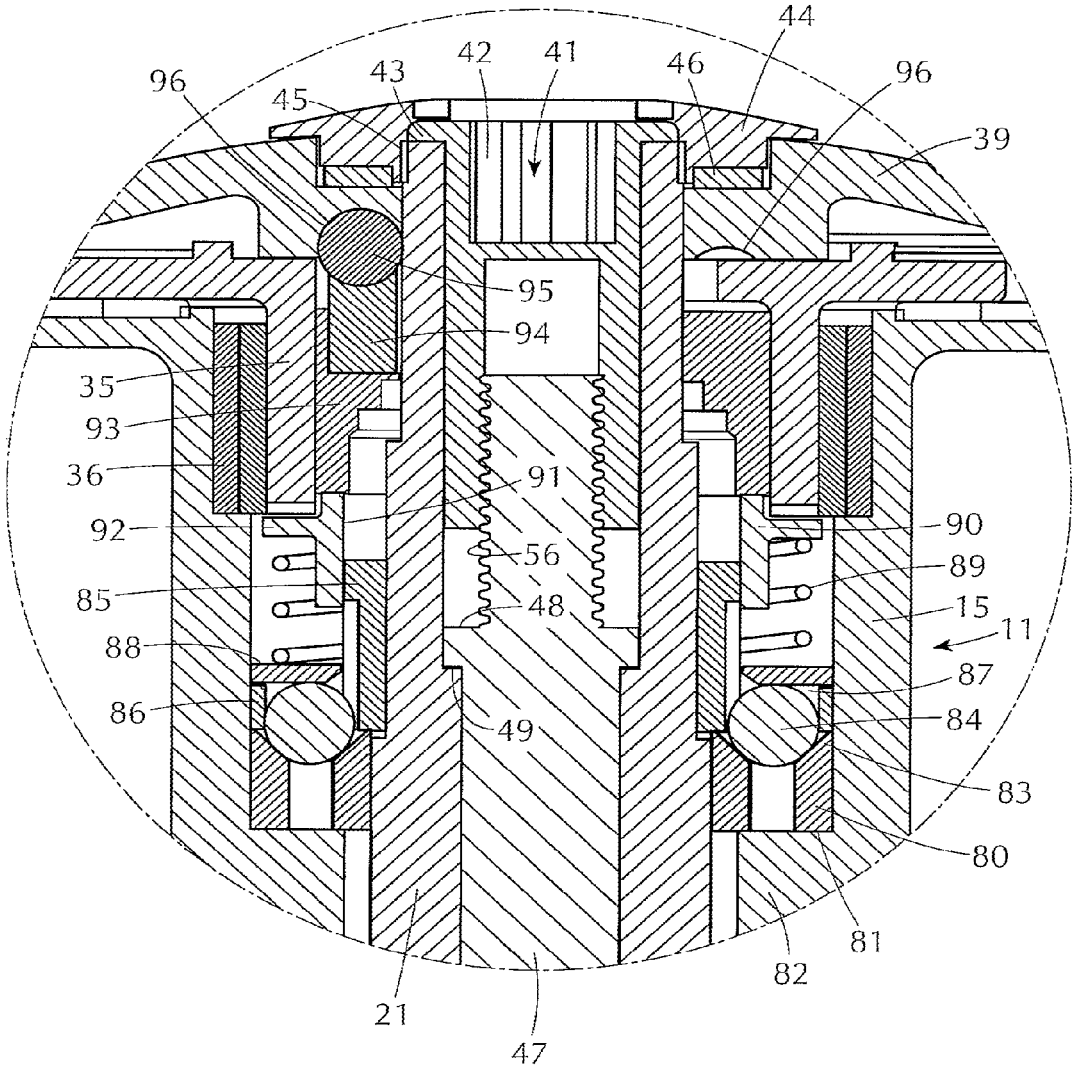

As shown in FIGS. 5 and 6, an elongated control stem 47 extends vertically through the upper portion of the drive sleeve 21. At its upper end, the control stem has a flange 48, which seats against a shoulder 49 formed in the drive sleeve 21. The upper extremity of the control stem is formed with a left-hand thread engaged with similar threads on the lower portion of the socket member 41. The control stem 47 has two limit positions, one shown in FIGS. 5 and 7, and the other in FIGS. 6 and 8. In FIGS. 5 and 7, the control stem is shown in an upper limit position, resulting from counterclockwise rotation of the socket member 41 by means of a winch handle. In FIGS. 6 and 8, the control stem 47 is shown moved to a downward limit position, as a result of clockwise rotations of the socket member 41, with the flange 48 being seated against the internal shoulder 49.

As reflected particularly in FIGS. 5 and 6, the control stem 47 is engaged with an extension 50, by means of a pin 51, and the lower end of this extension 50 is connected, by means of a pin 52, to the output shaft 19 of the motor drive. In a preferred form of the invention, the lower extremity of the primary drive sleeve 21 and the upper extremity of the drive shaft 19 are formed with axially engageable clutch teeth 53, 54 such that, when the control stem is in its upper limit position, shown in FIG. 5, the drive shaft 19 is locked together for rotation with the drive sleeve 21. In this configuration, operation of the drive motor 17 in the appropriate direction will result in corresponding rotation (clockwise or counterclockwise, as viewed from above) of the drive shaft 19 and, via the engaged clutch teeth 53, 54, corresponding rotation of the drive sleeve 21 and winding drum 11.

As will be noted in FIG. 5, when the control stem 47 is elevated, a narrow portion 55 of the extension 50 is positioned at the level of the drive balls 34. The dimensions of the narrow portion, the drive balls, and the drive sleeve 21, are such that, in this configuration, the drive balls are recessed entirely within the circumference of the drive sleeve 21. The drive sleeve can thus rotate independently of the large main drive gear 31, and vice versa. In this configuration, the winding drum 11 is driven exclusively by the drive motor 17. In the winch of the invention, the drive motor 17 is reversible and can operate the winding drum 11 in either winding or unwinding directions.

While it is anticipated that the winch will normally be operated exclusively under power, it is recognized that there can be circumstances (such as failure of on-board electrical and/or hydraulic power systems, when manual operation may be necessary. Accordingly, arrangements are provided for operating the winch manually whenever necessary or desirable. To convert the winch mechanism from power operation to manual operation, a winch handle is inserted into the socket member 41 and is rotated in a clockwise direction. The threads 56 (left handed) at the upper end of the control stem cause the stem to be driven downward until the flange 48 seats against the shoulder 49, as in FIGS. 6 and 8. As the control stem 47 moves downward, it carries with it the extension 50. A sleeve 57, which has limited vertical sliding movement on the upper portion 58 of the extension 50, is formed with a conical lower end face 59. During downward movement of the control stem 47 and extension 50, the conical end face 59 engages the drive balls 34 and presses downward and outward thereon. If the drive balls 34 are aligned with the drive ball recesses 33 in the main gear 31, the drive balls immediately move outward, and are retained in such outward position by the side walls of the sleeve 57 (see FIG. 6). If the drive balls are not initially aligned with the recesses 33, the sleeve 57 initially slides upwardly on the upper portion 58 of the extension 50 and continues to press against the drive balls. As soon as relative rotation occurs between the drive sleeve 21 and the main gear 31, the drive balls will immediately line up with the recesses 33 and will be displaced into such recesses, locking the gear and sleeve together for rotation under manual drive.

In the manual drive mode, rotations of the drive sleeve 21 result in rotations of the winding drum 11 on a one-to-one basis. Thus, manual rotation of the sleeve 21 by means of a winch handle engaged in the socket 41 results in operation of the winch on a high speed, low mechanical advantage basis.

As will be noted in FIGS. 5 and 6, the pin 52 securing the extension 50 to the upper end of the drive shaft 19 projects outward of the extension a short distance and is received in an internal annular groove 60 in the drive shaft. Accordingly, in the manual drive mode of the winch, the control stem 41 and extension 50 can rotate freely relative to the drive shaft 19. In the motor-powered mode, on the other hand, the drive shaft 19 is connected directly to the sleeve 21 via the clutch teeth 53, 54, and the sleeve 21, control stem 47, extension 50 and drive shaft 19 all rotate together.

In a preferred embodiment of the invention, provisions are made for multi-speed operation of the winch in the manual mode, to enable higher mechanical advantages to be utilized when line tensions become greater. To this end, a second winch handle socket 61 extends axially through the center of a level wind sleeve 63 (to be described later). At its lower end, the socket 61 engages a socket extension 64, which extends through the deck 10 of the yacht and engages a first gear set 65.

Figure 9:
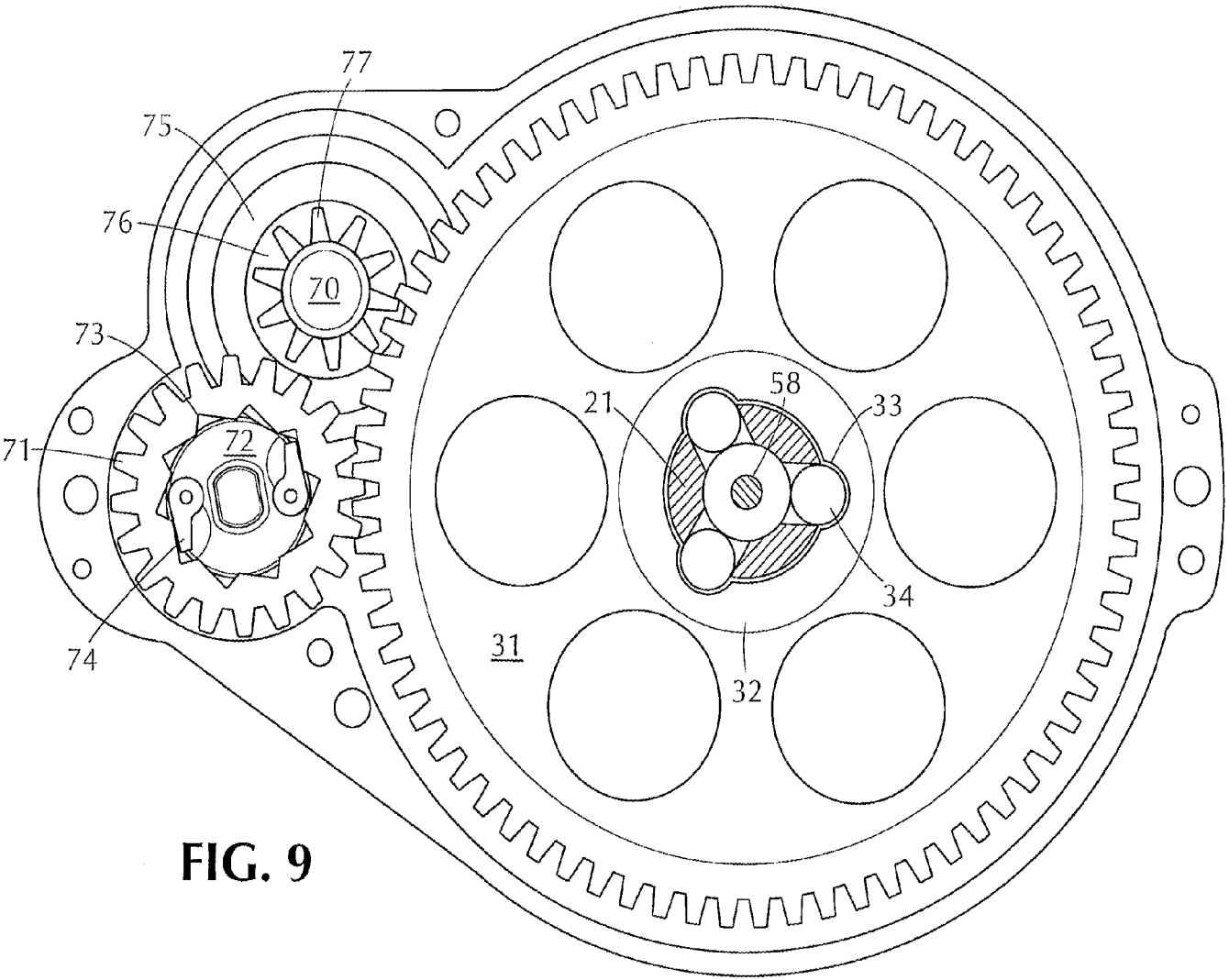
FIG. 9 is a top view looking into the open gear box illustrating arrangements for operating the winch under low speed manual operation.
Figure 10:
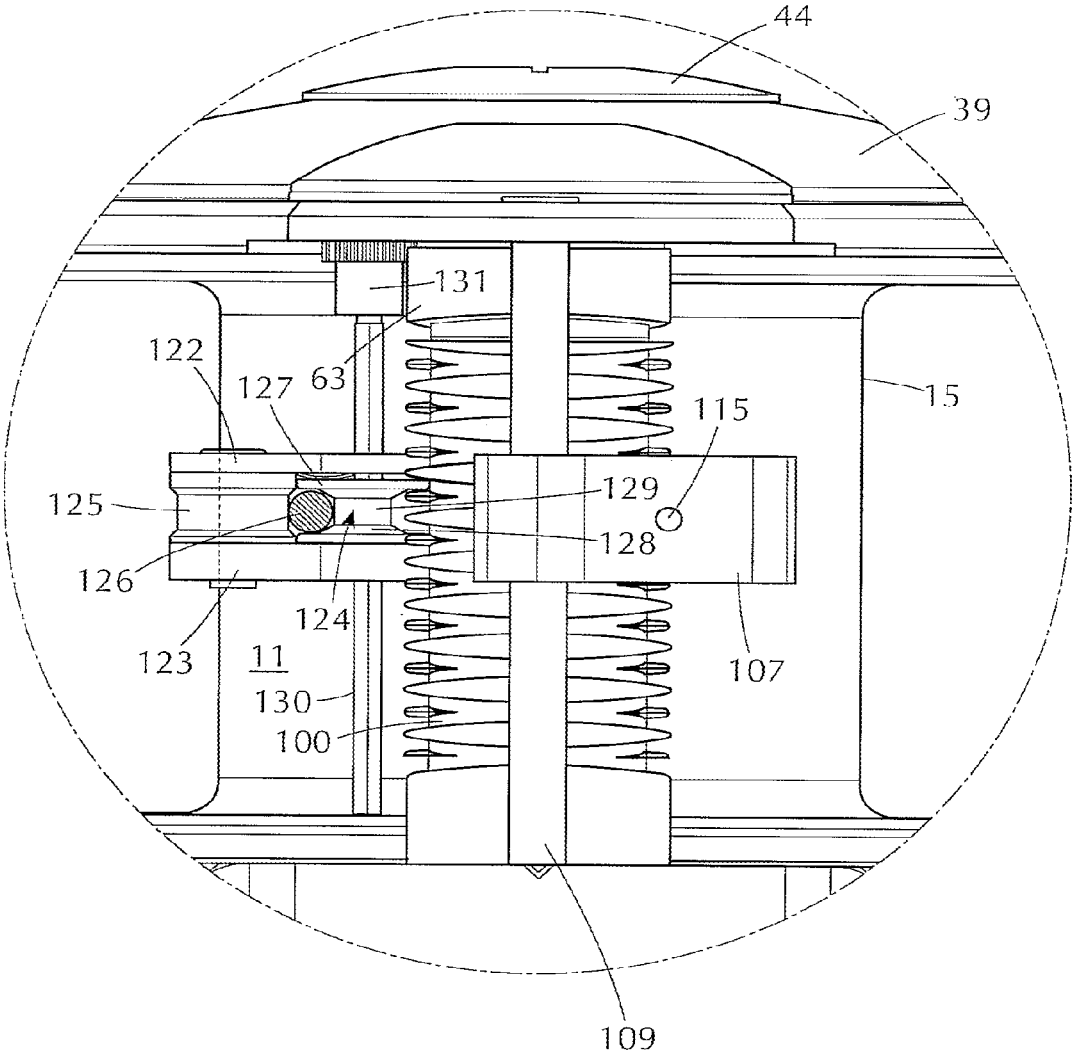
FIG. 10 is fragmentary end elevational view illustrating features of a novel level wind mechanism incorporated into the winch of the invention.

As illustrated in FIGS. 5, 6 and 9, the gear set 65 comprises a lower shaft extension 66 supported for rotation in bearing 67, and an upper shaft extension 68 drivingly connected with the socket extension 64. A pinion 69, forming an integral part of the shaft extension 66, is arranged for engagement with a second gear set 70 (FIG. 9) in lower portions of the gear box. A ring pinion 71 is rotatably mounted on a gear body 72, above the pinion 69, and has meshing engagement with the main drive gear 31. The ring pinion 71 is formed internally with a plurality of saw tooth-shaped recesses 73. A pair of spring-actuated drive pawls 74 are carried by the gear body 72 and are spring-urged outwardly to engage with the recesses 73. When the gear body 72 is rotated in a counterclockwise direction, the ring pinion 71 is driven by the pawls 74, driving the large diameter main gear 31 in clockwise rotation. With the drive balls 34 positioned as shown in FIG. 6, rotation of the main drive gear 31 simultaneously rotates the primary drive sleeve 21 and, through the line release clutch 38, the winding drum 11.

Clockwise rotation of the socket member 61 will rotate the body of the gear set 65 in a clockwise direction. In this rotational direction, the ring pinion 71 is not driven, as the spring pawls 74 simply slide by the recesses 73. The lower pinion 69, however, is fixed to the main body of the gear set and rotates in a clockwise direction. The pinion 69 engages a ring pinion 75 of the second gear set 70 and rotates it in a counterclockwise direction. The ring pinion 75 is of a similar character to the ring pinion 71 and is engaged with the main body 76 of the gear set 70 by means of drive pawls and recesses (not shown) similar to the recesses 73 and drive pawls 74 of the ring pinion 71. Counterclockwise rotation of the ring pinion 75 will result in counterclockwise rotation of a small diameter pinion 77, forming the upper portion of the second gear set, which meshes with the main drive gear 31 and drives it in a clockwise direction.

During operation in the manual mode, high winding speed, at low mechanical advantage, is achieved by operating the winch by a handle in the socket 41. With the winch handle engaged in the second socket 61, an intermediate speed, intermediate mechanical advantage is achieved by counterclockwise rotation of the handle, and low speed, high mechanical advantage operation is achieved by clockwise rotation of the handle. In the manual mode, the winding drum 11 is always rotated in the clockwise direction regardless of the direction of rotation of the winch handles, in order to wind line onto the reel. Release (unwinding) of the line is effected by operation of the line release clutch 38.

The illustrated form of the invention incorporates an advantageous form of line release/overload clutch 38, details of which are shown in FIGS. 7 and 8. The mechanism includes a ring element 80 which is seated in a recess 81 in the core wall 82 of the winding drum and is fixed to the winding drum for rotation therewith. The upper surface of the ring 80 is formed with a plurality, for example, twelve, of upwardly opening conical recesses 83 for the reception of clutch balls 84, with each recess 83 preferably containing a ball 84. The conical recesses 83 advantageously have an included angle around 90 degrees, and are proportioned such that clutch balls 84 are received in the recesses up to a depth of less than half their diameter.

A ball carriage 85 has a splined connection to the primary drive sleeve 21 for rotation with the sleeve 21. The ball carriage 85 has an outwardly extending flange 86 at its lower end, formed with a plurality of cylindrical recesses 87 which closely receive the exposed upper portions of the clutch balls 84. A flat ring washer 88 is positioned above the flange 86 and is arranged to bear downward on upper surfaces of the balls 84 retained within the vertical passages 87. A coil spring 89 bears on the flat washer 88 and is confined at the top by means of a flanged collar 90. The collar 90 has an inner wall 91, which is slideable vertically over outer wall portions of the ball carriage 85, and an outwardly extending flange 92, which overlies and confines the upper end of the coil spring 89.

As shown in FIGS. 7 and 8, a displacement ring 93 is slideably received within the cylindrical projection 35 of the winch cover and bears on the top of the flanged collar 90. A plurality (preferably three) of upwardly opening cylindrical recesses are formed in the collar to receive pins 94 mounting follower balls 95. The follower balls 95 are received in arcuate cam grooves 96 (one for each follower ball) formed in the underside of the actuating cap 39, which is mounted for limited rotational movement about the axis of the drive sleeve 21.

The arcuate cam grooves 96, over the extent of their arc, are relatively shallow at one end, as in the position directly over the follower ball 95 in FIG. 7, and gradually increase in depth toward the opposite end of their arcuate lengths (for example, 60 degrees), as shown at the right hand visible grooves 96 in FIG. 7. The geometric relation of the grooves and the several follower balls is such that all of the follower balls will simultaneously engage their respective grooves at the same level thereof. Thus, in one rotary position of the actuator 39, such as a first limit position shown in FIG. 7, all of the follower balls are engaged in the shallowest portions of their respective cam grooves 96. In an opposite limit position of the actuator 39, reflected in FIG. 8, all of the follower balls 95 are seated in the deepest portions of the cam grooves 96.

In the various rotary settings of the actuator cap 39, if a predetermined torque is applied between the drive sleeve 21 and the winding drum 11, the clutch balls 84 can be forced to rise out of their shallow recesses 83, move circumferentially and drop into the next adjacent recesses. This action occurs repeatedly as long as the torque applied to the winding drum exceeds the threshold established by the clutch setting. The maximum torque can be set very high, so that the clutch releases only under the highest torque and is, in practical effect, a positive drive. This setting would normally be used at all times for power operation of the winch. Upon rotation of the actuator cap 39 in a clockwise direction from its maximum torque position, the follower balls 95 will engage progressively deepening portions of the cam grooves 96, relieving pressure on the coil spring 89 and lowering the level of torque at which the clutch balls 84 can break free of their retaining recesses 83. In the limit position shown in FIG. 8, the absolute minimum of torque is required to permit rotation of the winding drum 11, so that the line can be freely stripped off of the drum, when needed.

When the winch is being operating in a manual mode, release of a line under substantial load, as for adjustment of sail trim, can be accomplished by controlled rotational movement of the clutch actuator cap 39 in the clockwise direction until, a limited length of line (often measured in inches or fractions of inches) is released. The actuator cap 39 is then returned to its maximum torque position.

In the illustrated form of the winch, an operating handle 97 is hinged to the actuator cap, as indicated in FIGS. 1 and 2. In the maximum torque setting of the winch, the handle can be folded downward into a groove 98, where the handle is safely out of the way and protected. To adjust the clutch, the handle 97 is pivoted upward to provide leverage for rotating the actuator cap 39. When the adjustments are finished, the handle can be returned to alignment with the groove 98 and folded into the groove to return the clutch to its normal maximum torque setting.

The clutch 38 can also serve an important function for line release when operating in a power mode. For example, if the yacht were to be overpowered by a very strong wind gust, and in danger of broaching, a sail could be instantly released by use of the clutch 38. Likewise, line can be controllably released for incremental sail trim by controllably releasing the clutch 38 without actuating the power drive of the winch. Normal power operation would be reestablished by return of the clutch actuator cap 39 to its normal position. The emergency release function is also significant when operating in a manual mode if the yacht is being overpowered by excessive winds.

In accordance with an aspect of the invention described and claimed in my co-pending application Ser. No. 11/759,398, a unique form of level wind feature is provided in the winch, immediately forward of the winding drum 11, serving to guide incoming line as it is wound upon the drum 11, such that the line is wound in neat, snug, side-by-side coils across the axial extent of the drum, between its upper and lower flanges. Importantly, the level wind mechanism of the invention serves to apply a desired level of resistance to line being wound onto the drum and also to apply considerable tension to line as it is being unwound from the drum. In this respect, during an initial phase of a line retrieving operation the line may be slack, and subject to being unevenly distributed on the drum, creating overrides, loosely wound coils, and other undesirable conditions. By applying a nominal resistance to the incoming line, by means of the level wind, immediately before the line is applied to the drum, a neat, uniform wind with tight coils is assured. Moreover, when the winch is being operated under power, which is expected to be the great majority of time, both winding-in and unwinding operations are performed under power. During unwinding operations, if the line is slack (which often will be the case) the line may not freely pay off of the rotating drum and move away, with the resultant possibility of partially re-winding line in the unwinding direction, leading to potential jamming of the winch. In the winch mechanism of the invention, however, the unwinding line, if not under tension loading from the sails, is placed under tension and pulled away from the drum by the level wind mechanism. This unique feature enables line to be released (unwound) by power operation of the winch. Indeed, it becomes possible to tack or gybe the yacht using a single common control that automatically activates both winches of a pair thereof, causing one to retrieve line and the other to release it, as the yacht is brought through the wind and the sail is transferred from one side to the other.

Figure 11:
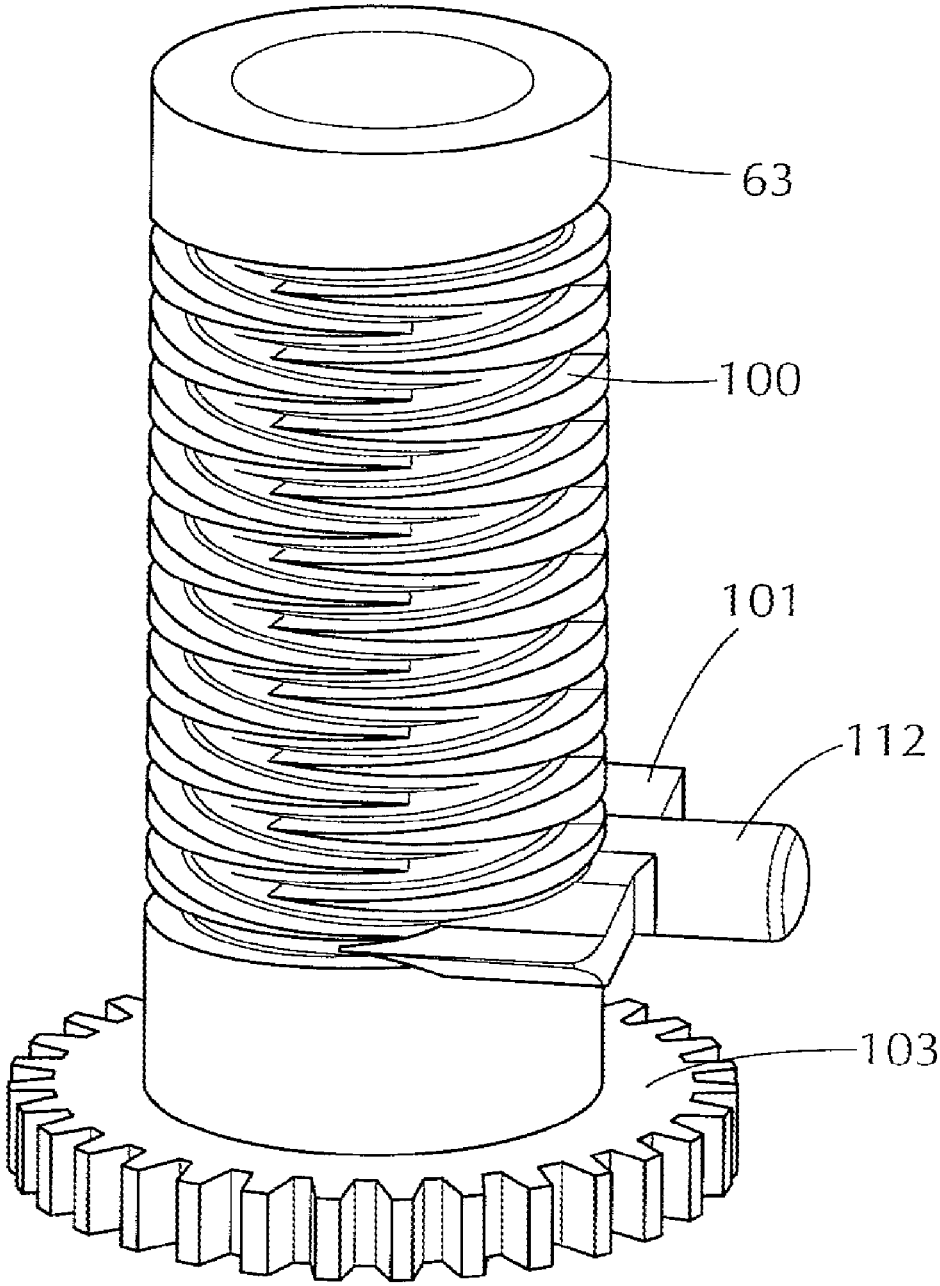
FIG. 11 is an enlarged perspective view illustrating features of a cam sleeve and follower blade forming part of the level wind mechanism.
Figure 12:
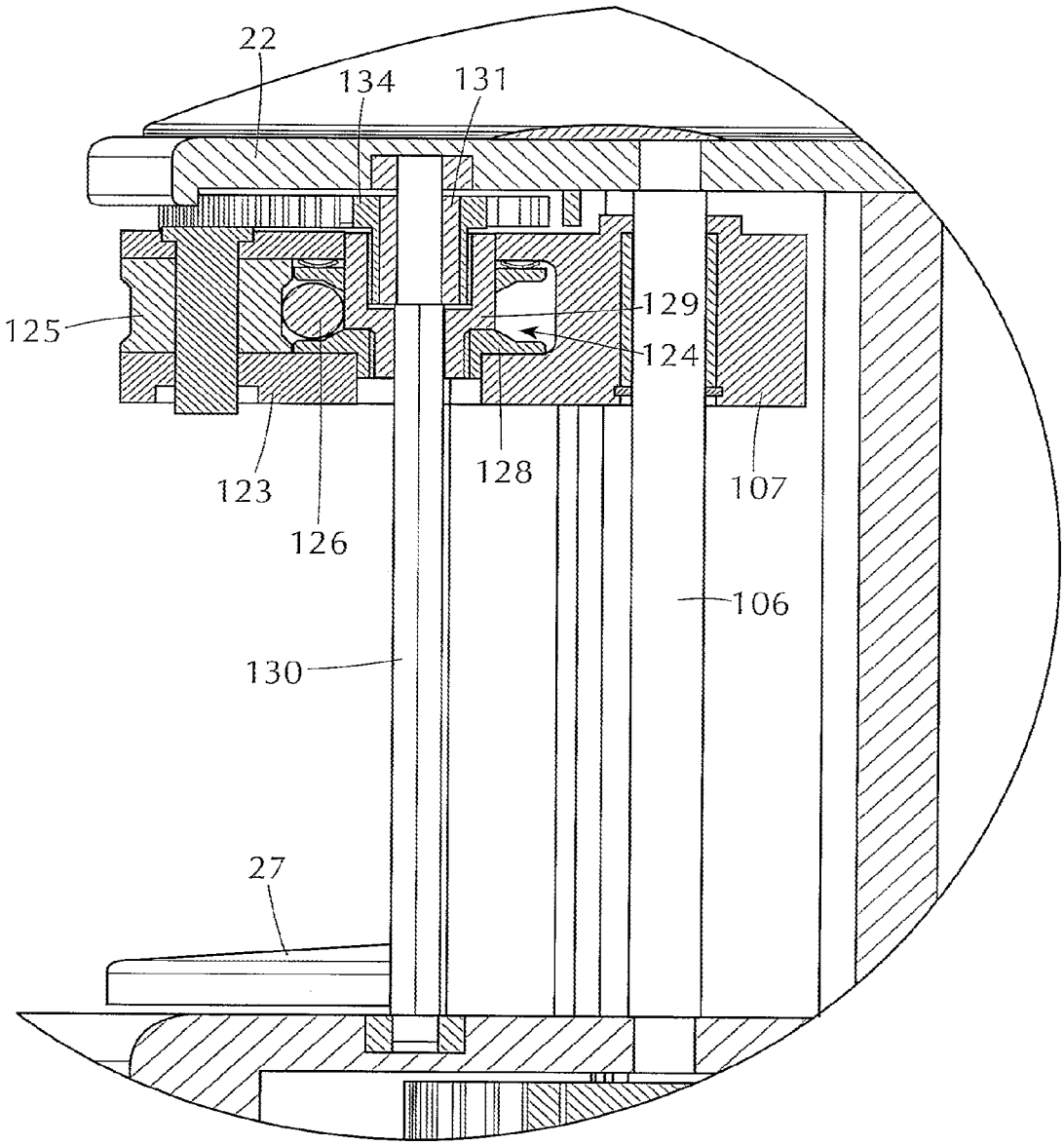
FIGS. 12 and 13 are fragmentary cross sectional views illustrating details of the level wind mechanism incorporated in the winch mechanism of the invention.
Figure 13:
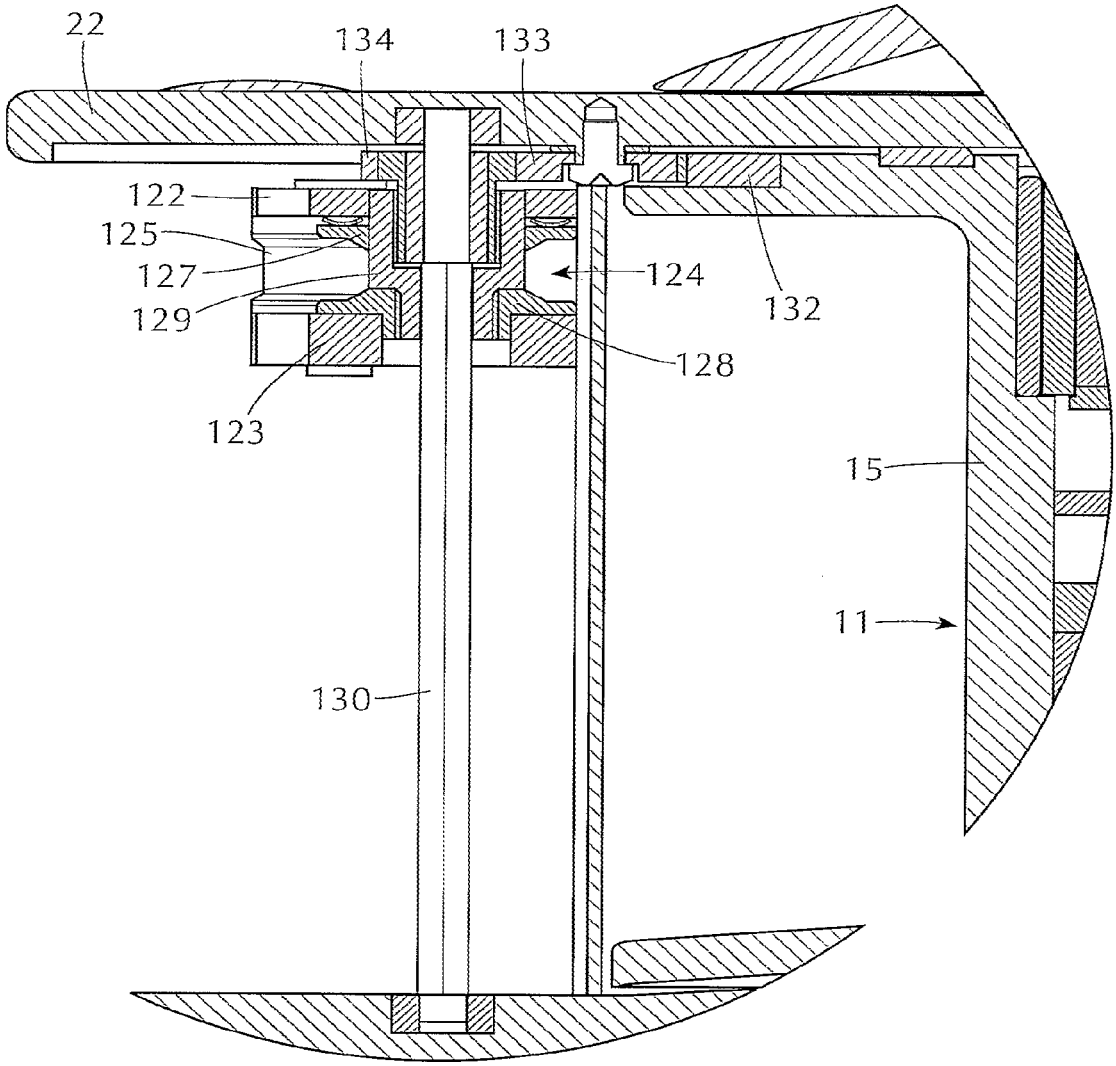
Figure 14:
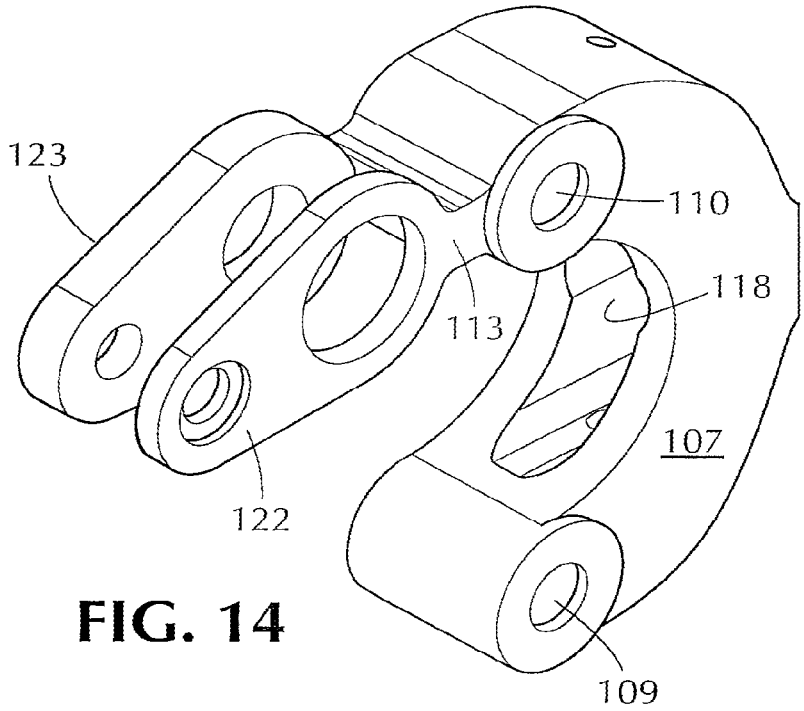
FIG. 14 is a perspective view of a yoke element forming part of the level wind mechanism.

In the illustrated structure, the level wind mechanism, generally designated by the numeral 12, includes the previously mentioned level wind sleeve 63, which surrounds the second socket member 61 and is mounted for rotation by the winch base 12 and cover structure 22. The sleeve 63, shown best in FIG. 11, is formed with a bi-directional cam groove 100 extending along a portion of its axial length corresponding to the effective axial length of the winding drum. A cam follower element 101, whose function will be further described, has a semicircular saddle portion 102 (FIG. 15), which is received in the cam groove 100. As the level wind sleeve 63 rotates, the follower element 101 travels up and down, from one axial end to the other of the groove. Upon reaching the end of the groove, the follower tilts slightly and enters the oppositely directed portion of the bi-directional groove.

At the bottom extremity of the level wind sleeve 63 is a gear 103, preferably formed integrally with the sleeve 63. In the assembled winch, shown in FIGS. 5 and 6, the gear 103 meshes with an idler gear 104 which in turn meshes with the gear portion 28 formed at the bottom of the winding drum 11. The sleeve 63 thus rotates synchronously with and as a direct function of rotation of the winding drum 11, independently of the manual or power driven configuration of the winch.

On the fore and aft sides of the level wind sleeve 63, there are vertical guide posts 105, 106 which slideably support a level wind yoke 107, shown best in FIGS. 10-15. The yoke 107 has a generally U-shaped mounting portion 108 provided on each side with vertical openings 109, 110 for slideably receiving the guide posts 105, 106 respectively.

The guide yoke 107 is provided with a threaded bore 111 arranged to receive a cylindrical extension 112, provided on the cam follower 101 (FIG. 11). The follower 101 is thus adapted for limited tilting movement about the axis of the extension 111. During continuous unidirectional rotation of the level wind sleeve 63, the follower 101 will continuously travel first along the upwardly inclined portion of the bi-directional groove 100 and, after reaching its limit at one end, will tilt about the axis of the extension 112 and enter the downwardly inclined portion of the cam groove in order to travel in the opposite direction along the length of the sleeve.

Figure 15:
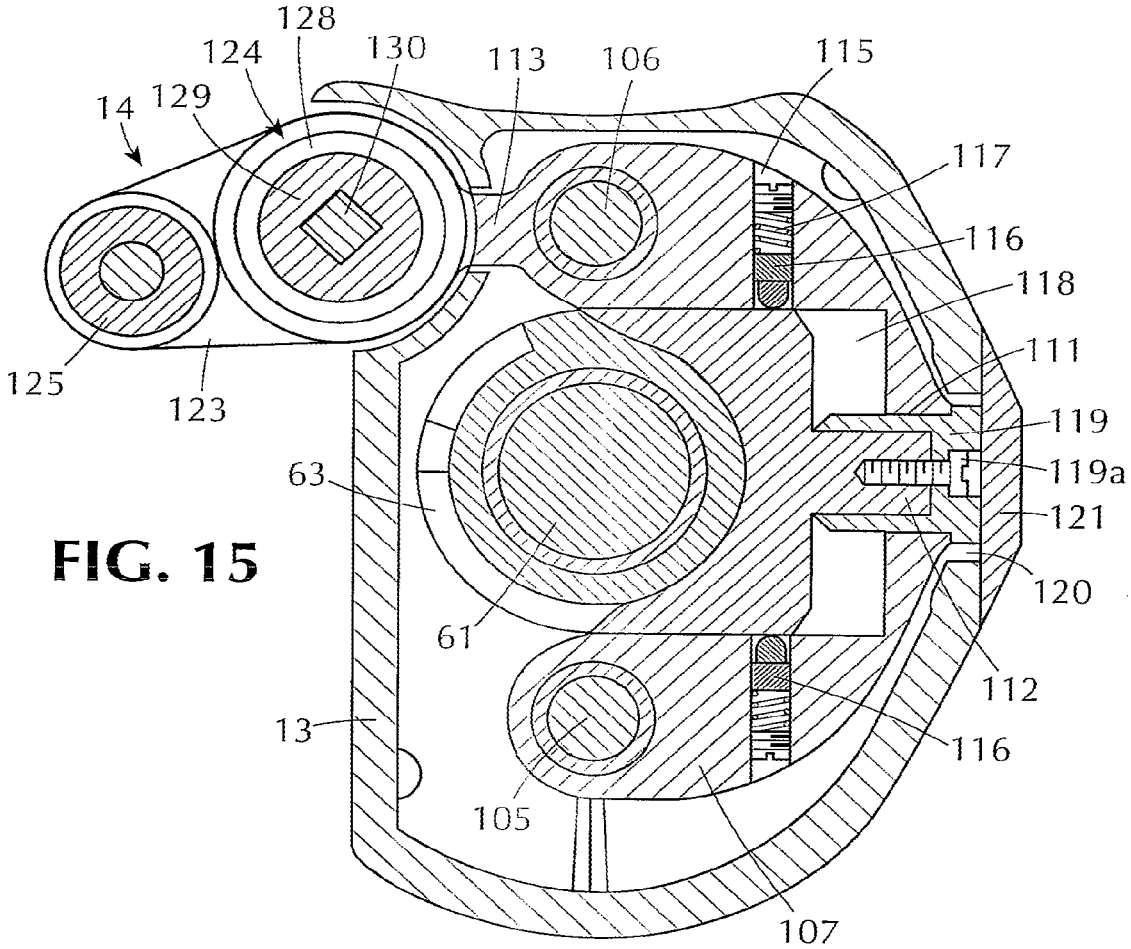
FIG. 15 is a fragmentary cross sectional view showing further details of the level wind mechanism.

To advantage, the level wind mechanism 12 incorporates detent elements acting on the follower element 101 to retain it in one tilted position or the other during its excursions up and down the sleeve 64. As shown in FIG. 15, the yoke 107 is provided on opposite sides with bores 115 in which are housed detent plungers 116, urged inward by springs 117 to engage outer edges of the cam follower 101. Each time the cam follower 101 reaches the end of its travel in one direction and is tilted for travel in the opposite direction, the opposed pair of detent plungers 116 retain the follower in its newly tilted position throughout the full extent of its excursion.

As shown in FIG. 15, the yoke 107 is formed with a recess 118 for receiving the cam follower 101 and which is of a greater depth than the cam follower, leaving a space behind the cam follower sufficient to allow the cam follower to be withdrawn from its cam groove 100 when necessary or desirable, as when dealing with a malfunction or other problem. For normal operations, the cam follower 101 should be maintained in the fully engaged position, shown in FIG. 15. This is accomplished by mounting a flanged cylindrical cap 119 at the end of the cam follower extension 112, by means of a screw 119*a*. The cap 119 has external threads engaging the threads of the bore 111 and is normally seated with its flange contacting the back surface of the yoke, to hold the cam follower 101 in operative engagement with the cam sleeve 63. To disengage the level wind mechanism, the cap 119 is engaged and rotated in a direction to retract the cam follower away from the cam sleeve to temporarily disable the level wind operation. The cap 119 is accessible through a vertical slot 120 in the level wind housing 13, which is normally closed by a removable cover strip 121.

The line guide 14 is attached to the level wind yoke 107 by a narrow neck portion 113, which projects through a vertical slot 114 (FIG. 2) in the level wind housing 13. Pursuant to the invention, the line guide 14 of the level wind mechanism includes a novel arrangement for applying a nominal resistance to the line during wind-up operations, to assure that the line is snugly wound on the drum 11, even though the line frequently may not be under any tension load from the sails. Additionally, and particularly important, the line guide includes means for imparting significant tension to the line during power driven unwinding operations, to assure that the line is positively stripped from the winding drum and cleared away from the line guide mechanism. In both cases, during winding and unwinding of the line, there are many periods (such as during tacking) when the line is slack and other periods when the line is under tension loading from the yacht's sails. When the line is slack, tension applied by the line guide arrangement is important during wind-up operations and may be critical during unwinding operations.

As shown in FIGS. 10-15, the line guide 14 of the invention includes upper and lower support arms 122, 123 supporting a pulley 124 and a confinement roller 125. The pulley 124 is formed with a generally V-shaped groove arranged to receive the working line 126, which is held in engagement with the groove by the roller 125. To advantage, the confinement roller 125 is secured by a removable pin, allowing the confinement roller to be removed, when necessary, for replacement of the working line.

The illustrated tension pulley 124 includes a vertically movable upper flange 127 which is spring loaded in the downward direction in order to snugly grip the line 126, which may vary slightly in diameter. The lower flange 128 of the tension pulley is fixed to a hub 129 on which the upper, spring loaded flange 127 is also mounted. The upper flange 127 is arranged for axial sliding movement toward and away from the lower flange 128, while being suitably keyed to the hub for rotation therewith. The hub 129 is slideably mounted on a vertical drive shaft 130, preferably of square cross section, such that the hub may travel along the length of the drive shaft 130 while remaining drivingly connected thereto, during normal excursions of the level wind mechanism.

Pursuant to the invention, the drive shaft 130 is connected through a one-way (Sprag) clutch 131 for rotation with the winding drum 11. For this purpose, a ring gear 132 (FIG. 13) is fixed to the upper flange of the winding drum and operates through an idler gear 133 to drive an outer gear 134 forming part of the Sprag clutch 131. When the winding drum 11 is being driven in the unwinding direction (i.e., counterclockwise) the drive shaft 130 will also be rotated in a counterclockwise direction to drive the tension pulley 124 in a direction to strip line off of the winding drum. The gear ratios are selected such that the tension pulley will always rotate at a sufficiently high speed to apply tension to the line 126 even when the drum is filled to a maximum diameter with the line 126. In this respect, it will be understood that there will always be a degree of slippage between the tension pulley 124 and the line 126 to assure that the line is always under tension between the tension pulley and the winding drum. To assure proper gripping of the line, the pulley flanges 127, 128 can be formed with slightly roughened surfaces and/or be formed of a material having suitable gripping characteristics with the line 126.

During winding-in operations of the winch, the winch drum 11 and the one-way clutch gear 134 will operate in clockwise directions. In this direction, the Sprag clutch 131 does not operate the drive shaft 130, and the tension pulley 124 applies resistance to the line as it passes through the confined space between the tension pulley and the confinement roller 125. The frictional gripping of the line by the spring-loaded tension pulley 124, is sufficient to impart a desired level of resistance to the line, between the line guide and the winch drum, to assure that the line is properly applied to the winch drum, in neat, snug, side-by-side coils, free of overrides, during wind-up operations.

One of the important advantages of the level wind arrangement of the invention is that it allows line to be unwound from the winding drum under all conditions, whether the line is under tension from a wind-loaded sail, or under no tension load whatever. With this unique facility, it becomes possible for the yacht winches to be power operated in the line-releasing, as well as line-retrieving directions. Moreover, it further allows a "one button" control of the yacht in carrying out tacking and gybing maneuvers, by utilizing a single unified control to automatically cause one winch to retrieve line and the opposite winch simultaneously to release line. Thus, in the schematic illustration of FIG. 16, winches 134, 135 on opposite sides of yacht 136 are provided with individual control devices 137, 138 respectively for independently controlling the power drives to the respective winches. Each of the individual controls operates the winch with which it is associated in a forward or reverse direction as desired, and with suitable variable speed control. Each of the winches 134, 135 can thus be operated with precision, each independently of each other. In addition, a common control 139 is provided, which is associated with both of the winches 134, 135 and connected such that operation of one of the winches in a winding-in direction is automatically accompanied by simultaneous operation of the opposite side winch in an unwinding direction. Thus, the operations involved in tacking or gybing a yacht, which normally require a considerable number of line handling operations, regardless of whether the winches are operated manually or by power, are entirely avoided with the system of the present invention. The operator merely actuates the control device 139 in the appropriate direction and the sail is automatically transferred from one side of the yacht to the other without any crew involvement at either winch.

Figure 16:
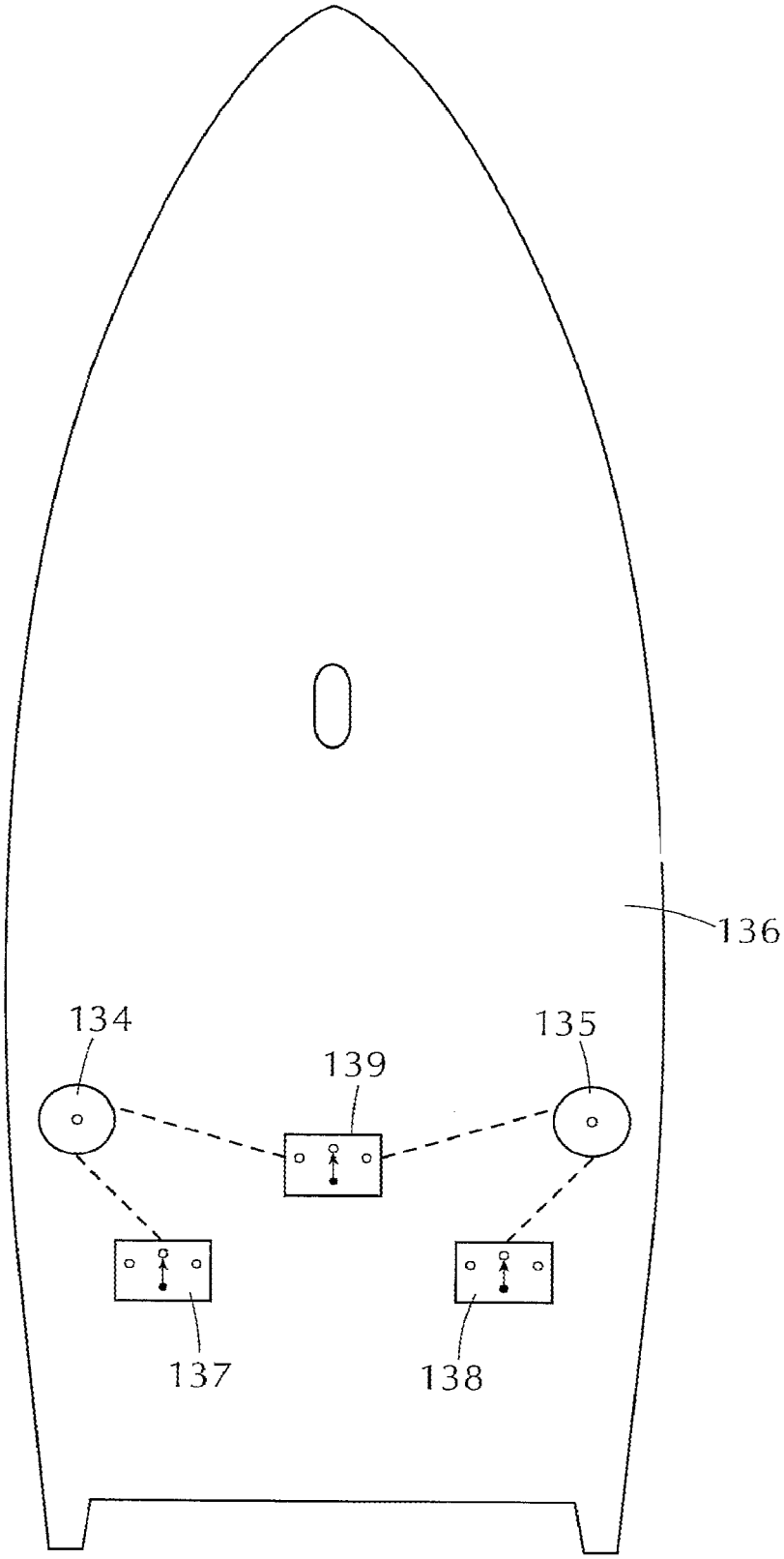
FIG. 16 is a highly simplified schematic representation of a power operated winch system according to the invention, including a common control for automatic operation of winches on opposite sides of a yacht.

It will be understood, of course, that the control units 137-139 need not be positioned at different locations, as suggested by the simplified schematic of FIG. 16, but may be combined at one or more control stations located conveniently on the yacht and/or incorporated in a hand held remote control unit. Moreover, the opposite side winches need not be operated by individual motors but may also be operated by a common motor with controllable clutches for individually or simultaneously connecting the winches to the common drive motor.

For "one button" control of the winches, the system advantageously will include programmable delay and/or speed control features. This will accommodate the fact that there typically is considerable slack to be taken, up on a windward sheet at the start of a tack, and also will compensate for variations in the effective diameters of the winch drums as line is released from one and retrieved by the other.

In a preferred embodiment of the invention, the winch arrangement can be provided with an especially low profile above the deck of the vessel, by mounting of the gear box 16 and related mechanisms below the deck, spaced below the winding drum and level wind mechanisms. This arrangement, which is best shown in FIGS. 1, 2, 5 and 6, includes upper and lower mounting plates which are positioned above and below the deck 10 and are tightly secured by screws 158 (FIG. 2) extending from one plate to the other. A plurality of spacer bolts 143-145 extend through the deck and mounting plates and also extend below the lower mounting plate 142 a distance sufficient to pass completely through the gear box 16. Each of the mounting bolts 143-145 (of which only 143 and 145 are shown in FIGS. 5 and 6), are provided at their upper ends with threaded portions 146, 147, which are threadedly received in similarly threaded openings provided in the upper mounting plate 141. The upper extremities of the mounting bolts are formed with positioning bosses 148, which are received in corresponding recesses formed in the underside of the winch base 12. It will be understood, that the third mounting bolt 144, which will not be separately described, is similar in structure to the mounting bolts 143, 145 that are visible in FIGS. 5 and 6.

After installation of the mounting plates 141, 142, the mounting bolts 143-145 are inserted upwardly through the lower mounting plate 142 and the deck 10 and are threadedly engaged with the upper mounting plate 141, until the positioning bosses 148 are properly projected above the upper surface of the mounting plate 141. The winch base 12 can then be seated over the mounting plate and positioning bosses 148 and secured. The winch base can be secured to the upper mounting plate by a plurality of screws (not shown), including a screw 159 which passes through a support portion 99 for the winch cover and the base 12, and is anchored in the upper portion of the mounting bolt 145.

The central body portions 149 of the mounting bolts, which are unthreaded in their upper portions and threaded in the lower portions 150, extend below the lower mounting plate 142. Large nuts 151 are threadedly engaged with the threaded portions 150 exposed below the lower mounting plate 142, serving to compress the upper and lower mounting plates 141, 142 and to rigidly secure the mounting bolts 143-145 therein.

In the illustrated arrangement, the gear box 16 comprises a lower housing 152 and a cover 153. The cover 153, which is secured to the housing by peripheral screws (not shown), is provided with suitable openings for the primary drive sleeve 21, and also for the extension 64, which connects with the gear set 65.

The lower portions of the mounting bolts 143-145 comprise shouldered locator sections 154 which are received in openings in the gear box cover 153 and seat against the upper surfaces of the gear box housing 152. Elongated extensions 155 of the mounting bolts pass downwardly through outer wall portions of the gear box housing and project slightly below the gear box, as reflected in FIGS. 1, 4 and 5. The projecting portions 156 of these extensions are threaded to receive nuts 157. These nuts, when tightened, seat the gear box tightly against the shouldered locator portions 154 such that the gear box is rigidly fixed in position with respect to the mounting plates 141, 142 and the above deck portions of the winch mechanism. The illustrations of FIGS. 1, 2, 5 and 6 show a more or less maximum expected deck thickness. For decks of less thickness, the nuts 151 are simply adjusted upwardly along the threaded portions 150 to seat tightly against the lower mounting plate 142. The spacing of the gear box 16 with respect to the above deck mechanisms remains the same. This arrangement also accommodates variations in deck thicknesses over the area of the winch base 12 and mounting plates 141, 142, as may result from normal production tolerances and variations.

The new winch mechanism incorporates a number of unique and very advantageous features. Among them is the ability to operate the winch under power in all phases of line handling, including the controlled release of line from the winch, with no manual intervention from crew members. The winch enables lines to be wound and stored on the winding drum, so as to be out of the way and so as not to pose a danger to crew members. With conventional winches, the numerous line manipulations involved in effecting line adjustments, whether taking in or letting out, and whether operating manually or under power, present many opportunities for missteps, especially (but by no means exclusively) with inexperienced crew members. There is significant potential for injury and/or equipment damage, increasing exponentially as wind velocities increase. With the winch of the present invention, lines can be taken in and stored on the winch drum, and controllably released from the drum, all by remote control under electrical or hydraulic power, with no manual handling of the lines required at any stage. This represents an important advance for the safety of crew members in charge of handling the lines.

The new winch takes full advantage of the use of modern, hi-tech lines, made of Kevlar, polyester, and other high strength materials. This enables the use of lines of about one-half the diameter of older, more conventional lines, providing for greater line storage capacity on the winch drum, and less windage and weight aloft which reduces heeling angles. In addition to greater strength, the new lines have less stretch and thus enable more accurate sail settings.

The ability to positively strip line off of the winch during line releasing operations is particularly important and beneficial because, among other things, it allows practical and effective power operation of the winch during release of line from storage on a winding drum. This facilitates very precise adjustment of the lines for continued refinement of sail trim and makes the entire operation very simple and risk free as compared to conventional winch and line handling. Moreover, this feature enables a unified control of winches on opposite sides of a yacht such that, during tacking and gybing for example, line may automatically be let out at one winch and taken in at the other, without any crew intervention. An entire tacking or gybing operation, which at times can be fraught with problems and risk of injury, is reduced to the operation of a single remote control, with no physical handling of the lines. This represents a major advance in sail handling aboard sailing yachts, particularly in the medium to large sizes, where the forces on running rigging lines can be dangerously large.

The performance of tacks and gybes using a single, unified control for automatically releasing line at one winch and retrieving at the other makes it possible for a yacht to be safely single handed, inasmuch as the necessary winch operations may be controlled by the helmsman without leaving the helming station. It also makes the handling of a yacht safer and more convenient when operating with a small and/or inexperienced crew or, for that matter, even with highly experienced crew.

The ability the new winch to wind and store line tightly and neatly on a winding drum, and to controllably release the line from such drum, has important advantages as compared to conventional winches. Among them, when lines are coiled and recoiled after operations with a conventional winch, the lines frequently become twisted, which can result in knotting and jamming when the line is passed through pulleys. In emergency conditions this can lead to serious problems. A further important advantage is derived from the unique form of level wind mechanism that imparts resistance to incoming line, and tension to outgoing line. Resistance to incoming line assures tight, neatly formed coils without crossovers, which have the potential for causing the line to jam, requiring the yacht to be turned off course and held into the wind to enable the jam to be cleared. Applying tension to outgoing line assures that the line is properly stripped off the winch drum during "unwinding" rotations of the drum, to avoid re-winding of line in the wrong direction and the probable resulting jam-up.

Increased safety is a significant advantage of the new winch. Even with highly experienced crew, sail handling operations with conventional winches always have the potential for causing serious injury. For example, if control of the line is lost because of a surprise wind gust or the like, recovery of the line can be difficult and dangerous. Or, if fingers of a crew member become trapped between the line and the winch body, serious injury may result. With the new winch, the lines are always under complete control and crew members do not need to be handling lines in the vicinity of the winch drum (if at all) and thus are not exposed to the risks involved with conventional winches.

The new winch also has the potential for increasing sailing activities for a variety of individuals who currently are either unwilling or unable to exert the efforts required for operating a typical sailing yacht. In addition to single handers, there is a large class of elderly sailors who will be able to safely and comfortably handle a yacht equipped with the new winchs, who might otherwise have chosen to retire from sailing activities or at least significantly restrict such activities. The ability to tack and gybe a yacht automatically, without physically handling the operative lines, makes it very much feasible for sailors to extend their sailing activities much later in life then otherwise. Additionally, by eliminating most of the physical activities from sail handling operations, the new winch can make sailing more comparable to power boating, for example, which some parties currently may view as preferable to sailing because of the apparent ease of operation of a power boat as compared to a conventional sailing yacht.

In the illustrated form of the invention, the winch is designed for use primarily in a power mode, with the alternate manual operation being provided principally as an emergency backup, in case of failure of the onboard power systems. However, it is contemplated that, for certain smaller sizes of yachts, the power drive may be eliminated altogether, with the winch being designed to be operated exclusively on a manual basis but otherwise incorporating features of the invention. In a similar manner, the winch of the invention may be designed for operation exclusively in a power mode, without providing mechanisms for backup manual operation. Such a winch can be provided at lower cost to yachtsmen willing to accept the risk of an occasional shipboard power malfunction.

The winch of the invention also may be provided in an alternative configuration in which the gear box is mounted above deck, especially (although not necessarily) where the winches are designed and intended to be operated exclusively in a manual mode.

Whether in the form illustrated herein, or in an alternative, manual-only form or power-only form, the new winch provides for significantly greater convenience and safety in the operation of a sailing yacht virtually eliminating the physical handling of lines during tacking, gybing and other maneuvers. Retrieval and easing of lines is accomplished exclusively by rotation of the winch drum, and not, as with conventional winches, by physical handling of the line itself, and excess line remains at all times wound on the winch drum instead of collecting haphazardly in the cockpit.

The specifically illustrated form of the new winch is focused largely on intended uses for trimming of sheets and halyards. However, the basic novel features of the winding drum and level wind arrangement can be easily adapted for other elements of running rigging, such as reefing lines, cunningham, outhaul, etc.

It should thus be understood that the specific form of the invention herein illustrated and described is representative only of the basic principles of the invention, and reference should be made to the following appended claims in determining the full scope of the invention.

The invention claimed is:

1. A sail managing winch for handling running rigging lines of a sailing yacht, which comprises (a) a rotatable winding drum having a core and spaced apart flanges and rotatable about a winding axis for winding and storing a line, (b) a bi-directional drive mechanism, including a primary drive member extending through the core of said winding drum for controllably driving said winding drum to rotate in line winding and unwinding directions, (c) a drive motor engageable with said drive mechanism and operable to controllably drive said primary drive member for rotation in winding and unwinding directions, and (d) an adjustable line release clutch mechanism connecting said primary drive member to said winding drum enabling said winding drum to rotate in an unwinding direction with respect to said drive mechanism to effect controlled release of rigging line from said winding drum by rotation of the winding drum independently of said motor.

2. A sail managing winch according to claim 1, wherein (a) said line release clutch mechanism comprises a first clutch element fixed to said winding drum for rotation therewith, a second clutch element fixed to said primary drive element for rotation with said primary drive mechanism, and an externally manually engageable variable adjusting element to vary the driving connection between said first and second clutch elements and thus between said motor and said winding drum.

3. A sail managing winch according to claim 2, wherein (a) the variable adjusting element of said line release clutch mechanism has a range of adjustment positions to accommodate, at one limit position, substantially free rotation of said winding drum relative to said motor in a line-releasing direction and to provide, at an opposite limit position, a substantially positive drive connection between said motor and said winding drum.

4. A winch according to claim 2, wherein (a) one of said first and second clutch elements comprises a circular ring and has a plurality of axially facing, outwardly divergent recesses therein spaced circumferentially about the ring, (b) a plurality of clutch balls are partially received in said recesses, (c) the other of said first and second clutch elements is provided with a plurality of axial bores for partially receiving and circumferentially confining clutch balls partially received in said axially facing recesses, and (d) an adjustable pressure mechanism is provided for exerting variable axial pressure on exposed portions of said clutch balls, enabling relative rotation between said first and second clutch rings when torque acting between said winding drum and said primary drive member exceeds resistance between said clutch balls and said one of said clutch elements, causing each of said clutch balls to move circumferentially from one recess to an adjacent recess.

5. A winch according to claim 4, wherein said adjustable pressure mechanism comprises (a) a clutch actuator cap mounted at a top of said winch and rotatable with respect thereto, (b) said actuator cap having one or more inclined cam surfaces on an underside thereof, (c) one or more cam follower elements associated with said one or more cam surfaces and adapted for axial displacement upon rotation of said actuator cap, and (d) a resilient member is positioned to act on said clutch balls and is arranged to be compressed and released by movement of said cam follower elements, to controllably increase and decrease a torque level at which said winding drum is released to rotate with respect to said primary drive member.

6. A winch according to claim 5, wherein (a) said clutch actuator cap is provided with a plurality of inclined cam surfaces on the underside thereof, and (b) said one or more cam follower elements comprise a plurality of roller balls, one engaged with each of said inclined cam surfaces.

7. A winch according to claim 6, wherein (a) a collar underlies said actuator cap and is arranged for axial movement toward and away from said resilient member for compressing and releasing said resilient member, (b) a plurality of support pins are mounted by said collar, at circumferentially spaced intervals and extend upward therefrom, and (c) said roller balls are supported in concave upper surfaces of said support pins.

8. A winch according to claim 5, wherein (a) said clutch actuator cap is mounted for rotation about the axis of said winding drum, (b) an operating handle is pivotally attached to said actuator cap and is pivotable between a first position, disposed generally radially about said axis to facilitate rotary adjustment of said actuator cap, and a second position, folded downward against said winch, (c) said winch is provided with a housing structure partially enclosing said winch, and (d) a recess is formed in said housing structure to at least partially receive said operating handle in its folded, second position.

* * * * *